US007446716B2

(12) United States Patent
Watanabe et al.

(10) Patent No.: US 7,446,716 B2
(45) Date of Patent: Nov. 4, 2008

(54) ELECTRONIC DEVICE

(75) Inventors: Fuminori Watanabe, Yokohama (JP); Ryuta Sonota, Yokohama (JP); Koji Aoki, Yokohama (JP); Koji Ikawa, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 184 days.

(21) Appl. No.: 11/451,475

(22) Filed: Jun. 13, 2006

(65) Prior Publication Data

US 2006/0284772 A1 Dec. 21, 2006

(30) Foreign Application Priority Data

Jun. 16, 2005 (JP) ..... 2005-176714

(51) Int. Cl.
*H01Q 1/24* (2006.01)

(52) U.S. Cl. ..... 343/702; 439/11; 439/136

(58) Field of Classification Search ..... 343/702; 439/8, 11, 13, 136, 916
See application file for complete search history.

(56) References Cited

U.S. PATENT DOCUMENTS 6,359,591 B1 * 3/2002 Mou ..... 343/702
6,366,261 B1 4/2002 Stout et al.
6,394,813 B1 5/2002 Stout et al.
6,612,874 B1 9/2003 Stout et al.
6,758,689 B1 * 7/2004 Bair et al. ..... 439/136
6,853,336 B2 * 2/2005 Asano et al. ..... 343/702
6,908,324 B1 * 6/2005 Morley et al. ..... 439/218
7,172,428 B2 * 2/2007 Huang ..... 439/11

FOREIGN PATENT DOCUMENTS

JP 2002-353718 12/2002

* cited by examiner

*Primary Examiner*—Tho G Phan
(74) *Attorney, Agent, or Firm*—Oblon, Spivak, McClelland, Maier & Neustadt, P.C.

(57) ABSTRACT

A display unit includes a conductive portion 1. When it is assumed that there is an imaginary straight line $m_1$, which extends in a direction perpendicular to a longitudinal direction of a dipole antenna 2, passes through a center of the dipole antenna 2 and is parallel to an antenna surface of the dipole antenna 2, the dipole antenna 2 is disposed on a lateral side of the display unit so that the imaginary straight line $m_1$ is parallel to a display screen, is parallel to an upper side 1*a* or a lower side 1*b* of a main surface of the conductive portion and passes a lateral portion of the conductive portion 1. When the dipole antenna has a length $L_A$ in the longitudinal direction thereof, when the conductive portion has a thickness T, and when a radio wave for communication with the external device has a wavelength $\lambda_0$ in the air, the formula of $\lambda_0 \geqq L_A \geqq T$ is established, a one side of the conductive portion has a greater length than the wavelength $\lambda_0$, and a shortest distance d between each of peripheral portions of radiating conductors 2*a* and 2*b* and a peripheral portion of the conductive portion ranges from $(L_A/10)$ to $6L_A$.

21 Claims, 20 Drawing Sheets

ELECTRONIC DEVICE

BACKGROUND OF THE INVENTION

1. Field of the Invention

The present invention relates to an electronic device, which is suited for performing at least one of transmittance and reception of, e.g., a displayed content on a display unit between an external communication device and the electronic device having the display unit included therein.

2. Discussion of Background

Heretofore, there has been reported a technique wherein an antenna device is put into a connector complying with the USB (Universal Serial Bus) standard and provided on a lateral side of a personal computer (hereinbelow, referred to as USB connector), whereby the personal computer is configured so as to be capable of performing communication with an external device (see, e.g., FIG. 1 of U.S. Pat. No. 6,394,813 and FIG. 1 of U.S. Pat. No. 6,612,874).

However, when the antenna of an external device is located at a position, which is on a side opposite the side of a personal computer with the USB connector located therein so that a radio wave is blocked by the display unit of the computer, there has been caused a problem that a communication failure occurs since the radio wave is blocked by the display unit of the computer. In other words, the antenna device is not configured so as to be omnidirectional since there is a null point in a specific angular direction in the angular range of from 0 deg to 360 deg in the horizontal direction as viewed from the antenna device.

SUMMARY OF THE INVENTION

It is an object of the present invention to provide an electronic device and a communication system, which are capable of solving the above-mentioned problem incurred in the conventional technique, and which has not been known until now.

The present invention provides an electronic device including a flat display unit having a thickness and a dipole antenna for communication with An electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface;

wherein in a case where a plane containing a main part of radiating conductors of the dipole antenna is called an antenna surface, when it is assumed that there is an imaginary straight line $m_1$, which extends in a direction perpendicular to a longitudinal direction of the dipole antenna, passes through a center of the dipole antenna in the longitudinal direction and is parallel to the antenna surface, the dipole antenna is disposed on the lateral portion or in the vicinity of the lateral portion of the display unit so that the imaginary straight line $m_1$ is parallel or substantially parallel to the display screen of the display unit, is parallel or substantially parallel to an upper side or a lower side of the main surface of the conductive portion and passes through the lateral portion of the conductive portion or has contact with the lateral portion;

the electronic device having a function of communicating with the external device through the dipole antenna;

wherein when the dipole antenna has a length $L_A$ in the longitudinal direction thereof, when the conductive portion has a thickness T, and when a radio wave for communication with the external device has a wavelength $\lambda_0$ in the air, the formula of $\lambda_0 \geqq L_A \geqq T$ is established; and at least one of the four sides forming the rectangular or substantially rectangular shape of the conductive portion having a greater length than the wavelength $\lambda_0$;

wherein when the formula of $La=(\lambda_0/2)$ or $La\approx(\lambda_0/2)$ is established, a shortest distance d between each of the peripheral portions of the radiating conductors and the lateral portion of the conductive portion ranges from $(\lambda_0/20)$ to $3\lambda_0$; and wherein when the formula of $L_A \neq (\lambda_0/2)$ is established or when the formula of $L_A \approx (\lambda_0/2)$ is not established, the shortest distance range from $(L_A/10)$ to $6L_A$.

The present invention also provides an electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface;

wherein when it is assumed that there is an imaginary straight line $P_1$, which passes through a center of the dipole antenna, is parallel to the display screen of the display unit and is parallel to an upper side or a lower side of the main surface of the conductive portion, the dipole antenna is disposed on the lateral portion or in the vicinity of the lateral portion of the display unit so that the imaginary straight line $P_1$ passes the lateral portion of the conductive portion or has contact with the lateral portion;

the electronic device having a function of communicating with the external device through the dipole antenna;

wherein when the dipole antenna has a length $L_A$ in the longitudinal direction thereof, when the conductive portion has a thickness T, and when a radio wave for communication with the external device has a wavelength $\lambda_0$ in the air, the formula of $\lambda_0 \geqq L_A \geqq T$ is established; and at least one of the four sides forming the rectangular or substantially rectangular shape of the conductive portion having a greater length than the length $L_A$;

wherein it is assumed that there is a vertical imaginary surface $S_1$, which is perpendicular to the display screen of the display unit, when a smaller angle among the angles, at which the longitudinal direction of the dipole antenna intersects with the surface $S_1$, is defined as $\gamma$, the formula of $-70$ deg$\leqq$70 deg is established; and wherein in a case where there is an imaginary straight line n, which has contact with a farthest leading edge of the dipole antenna projecting from a thickness of the conductive portion in a direction perpendicular to the display screen of the display unit, is parallel to the display screen of the display unit and is parallel to the upper side or the lower side of the main surface of the conductive portion, when a shortest distance between the lateral portion of the conductive portion and the imaginary straight line n is defined as $L_{AP}$, the formula of $0.4 \leqq (L_{AP}/L_A) \leqq 2.5$ is established.

The present invention also provides an electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface;

wherein in a case where a plane containing a main part of radiating conductors of the dipole antenna is called an antenna surface, when it is assumed that there is an imaginary straight line $m_1$, which extends in a direction perpendicular to a longitudinal direction of the dipole antenna, passes through a center of the dipole antenna in the longitudinal direction and is parallel to the antenna surface, the dipole antenna is disposed on the lateral portion or in the vicinity of the lateral portion of the display unit so that the imaginary straight line $m_1$ is parallel or substantially parallel to the display screen of the display unit and is parallel or substantially parallel to an upper side or a lower side of the main surface of the conductive portion;

wherein a smaller angle of angles, at which the longitudinal direction of the dipole antenna intersects with the display surface of the conductive portion, is defined as $\alpha$, and the dipole antenna has a length $L_A$ in the longitudinal direction thereof;

wherein in a case where there is an imaginary straight line n, which has contact with a farthest leading edge of the dipole antenna projecting from a thickness of the conductive portion in a direction perpendicular to the display screen of the display unit, is parallel to the display screen of the display unit and is parallel to the upper side or the lower side of the main surface of the conductive portion, when a shortest distance between the lateral portion of the conductive portion and the imaginary straight line n is defined as $L_{AP}$, and when the thickness of the conductive portion is defined as T;

at least one of the four sides forming the rectangular or substantially rectangular shape of the conductive portion having a greater length than the length $L_A$; and the following formula (1) is satisfied provided that the formula of $L_A \cdot \sin|\alpha| \leqq T$ is established:

$$0.2 \leqq (L_{AP}/L_A) \leqq 2.5 \quad (1)$$

where sin $\alpha$ has a value satisfying the formula (1).

The present invention also provides an electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface, the display unit having the dipole antenna disposed in the lateral portion or in the lateral portion thereof;

the electronic device having a function of communicating with the external device through the dipole antenna;

wherein it is assumed that there is a vertical imaginary surface $S_1$, which is perpendicular to the display screen of the display unit, when a smaller angle of the angles, at which the longitudinal direction of the dipole antenna intersects with the surface $S_1$, is defined as $\gamma$, the formula of $-70 \text{ deg} \leqq 70 \text{ deg}$ is established;

wherein a smaller angle of angles, at which the longitudinal direction of the dipole antenna intersects with the display surface of the conductive portion, is defined as $\alpha$, and the dipole antenna has a length $L_A$ in the longitudinal direction thereof;

wherein in a case where there is an imaginary straight line n, which has contact with a farthest leading edge of the dipole antenna projecting from a thickness of the conductive portion in a direction perpendicular to the display screen of the display unit, is parallel to the display screen of the display unit and is parallel to the upper side or the lower side of the main surface of the conductive portion, when a shortest distance between the lateral portion of the conductive portion and the imaginary straight line n is defined as $L_{AP}$, and when the thickness of the conductive portion is defined as T;

at least one of the four sides forming the rectangular or substantially rectangular shape of the conductive portion having a greater length than the length $L_A$; and provided that the angle $|\alpha|$ is from 20 to 90 deg, the formula of $0.7 \leqq L_{AP}/L_A \leqq 2.2$.

In accordance with the present invention, it is possible to configure an electronic device so as to have no null point in the angular range of from 0 deg to 360 deg. in the horizontal direction or substantially in the horizontal direction as viewed from the dipole antenna according to the present invention and to be omnidirectional by adopting the above-mentioned structure. Even if the communication antenna of an external device is located on a side opposite the dipole antenna, it is possible to have a good communication efficiency and a sufficient antenna gain.

DETAILED DESCRIPTION OF PREFERRED EMBODIMENTS

Now, the electronic device according to the present invention will be described in detail, based on preferred embodiments shown in the accompanying drawings. The present invention is broadly classified into a first embodiment and a second embodiment. The first embodiment is a mode suited for a case where a conductive portion has a relatively small thickness in comparison with the second embodiment described later.

The first embodiment is further classified into a mode wherein the mounting angle of a dipole antenna to a display unit is narrow (a narrow angle mode in the first embodiment) and a mode wherein the mounting angle of the dipole antenna to the display unit is wide (a wide angle mode in the first embodiment).

Figure 1:
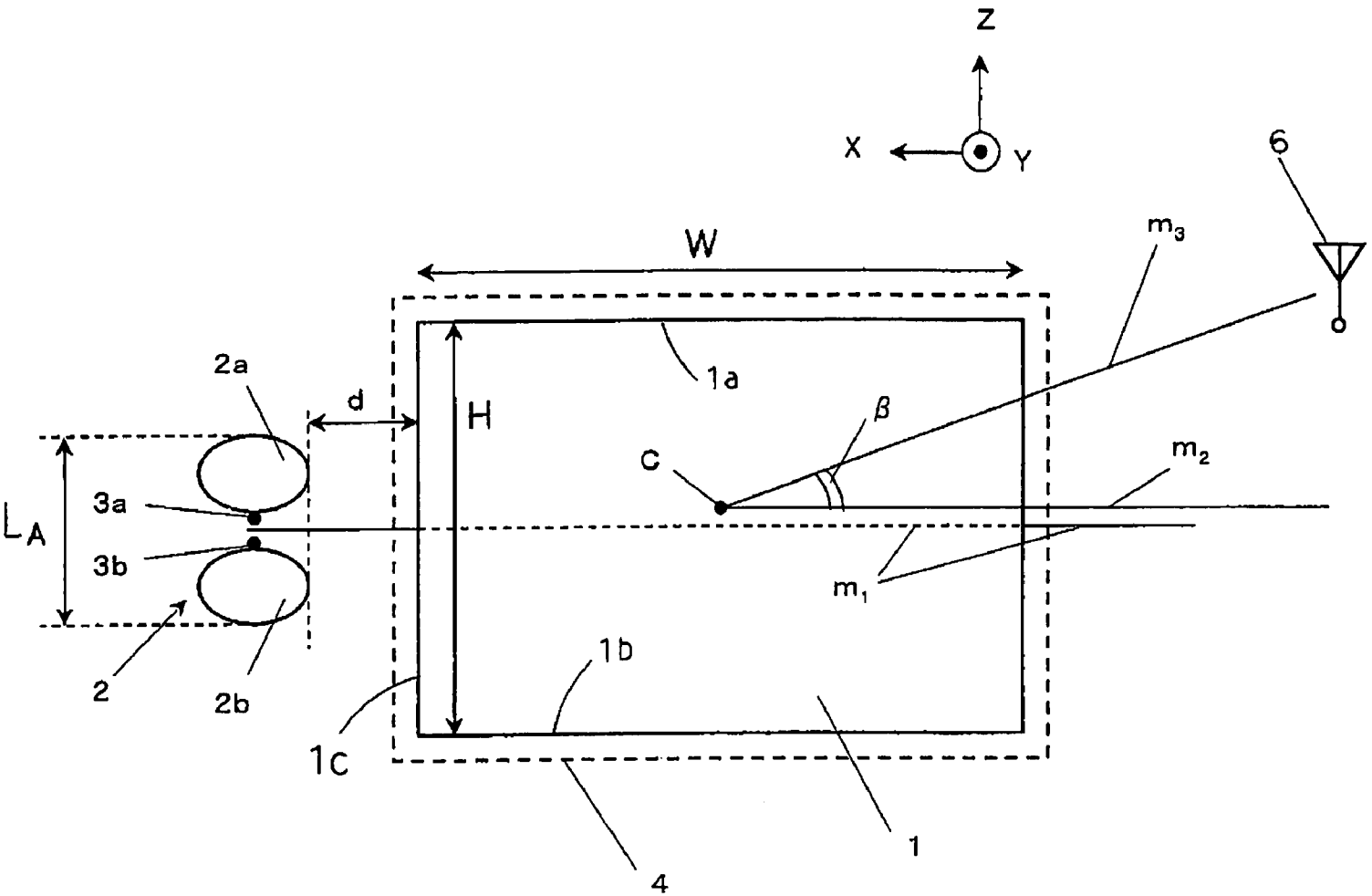
FIG. 1 is a front view showing the basic structure of the electronic device according to a narrow angle mode in a first embodiment of the present invention.
Figure 2:
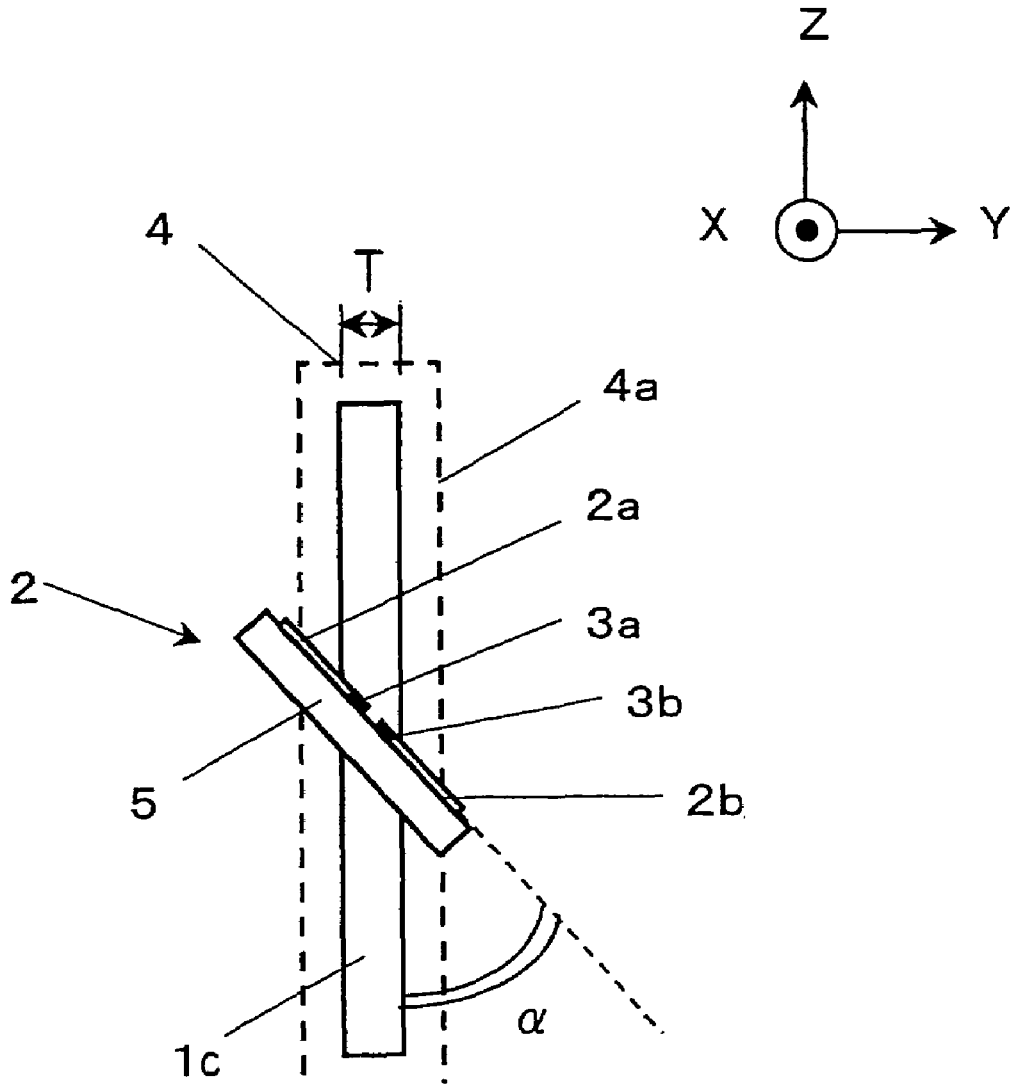
FIG. 2 is a side view of the electronic device according to the narrow angle mode in the first embodiment shown in FIG. 1, as viewed from the side of a dipole antenna.

(1) FIG. 1 is a front view showing the basic structure of the narrow angle mode in the first embodiment in connection with the electronic device according to the present invention. FIG. 2 is a side view of the electronic device as viewed from the side of a dipole antenna 2.

(1-1) Narrow Angle Mode in First Embodiment

In FIGS. 1 and 2, reference W designates the width of a conductive portion 1, and reference H designates the height of the conductive portion 1. The X-axis is a horizontal axis parallel to a display screen 4*a* of a display unit 4, the Y-axis is a horizontal axis vertical to the display unit 4, and the Z-axis is an axis parallel and vertical to the display unit 4. These conditions are applied to the respective views showing the basic structures of the present invention described later.

First, the first embodiment of the present invention will be described. The electronic device according to the present invention includes the display unit 4 in a flat shape and the dipole antenna 2. The display unit 4 includes the conductive portion 1, which is formed in a rectangular or substantially rectangular shape, and which has a main surface parallel to the display screen 4*a* of the display unit and a lateral portion 1*c* positioned at an lateral edge of the main surface. The display unit 4 is configured so as to have such a shape and dimensions that the conductive portion 1 is partly or entirely contained by the display unit 4.

The dipole antenna 2 shown in FIGS. 1 and 2 has a pair of radiating conductors 2*a* and 2*b* entirely disposed in planar fashion on a dielectric substrate 5. However, the present invention is not limited to have such a structure. In the present invention, it is sufficient that the main portions of the paired radiating conductors are included in the antenna surface. It is preferred in terms of improving the radiation efficiency that 50% of the radiating conductors, in particular 80% of the radiating conductors, be contained in the antenna surface. It is preferred in consideration of compactness or the like that the dipole antenna according to the present invention be a so-called planar antenna, wherein the radiating conductors are partly or entirely disposed in planar fashion on or in a dielectric substrate or a dielectric member. It is preferred that the dipole antenna according to the present invention have a low property of radiating a radio wave in a longitudinal direction or substantially longitudinal direction and be substantially omnidirectional in the other directions.

In the present invention, it is possible to improve the antenna gain even if the communication antenna 6 of an external device, which communicates with the electronic device, is located on a side opposite the lateral portion 1*c* of the display unit with the dipole antenna disposed thereon. One of the dipole antenna 2 and the antenna 6 of the external device has at least one of a reception function and a transmission function, and the other has the other function.

In the mode shown in FIGS. 1 and 2, when it is assumed that there is an imaginary straight line $m_1$, which extends in a direction perpendicular to the longitudinal direction of the dipole antenna 2, passes through the center of the dipole antenna 2 in the longitudinal direction and is parallel to the antenna surface, the dipole antenna 2 is disposed on the lateral portion 1*c* or in the vicinity of the lateral portion 1*c* of the display unit 4 so that the imaginary line $m_1$ is parallel or substantially parallel to the display screen 4*a* of the display unit 4, is parallel or substantially parallel to an upper side 1*a* or a lower side 1*b* of the main surface of the conductive portion 1 and passes the lateral portion 1*c* of the conductive portion 1 or has contact with the lateral portion.

In the narrow angle mode in the first embodiment and the wide angle mode in the first embodiment, it is preferred in consideration of the inclination tolerance of the pole antenna 2 that the dipole antenna be disposed so that a smaller angle of the angles, at which the imaginary line $m_1$ intersects with the display screen 4*a* of the display unit, ranges from −20 deg to 20 deg. It is preferred that the dipole antenna be disposed so that a smaller angle of the angles, at which the imaginary line $m_1$ intersects with respect to the upper side 1*a* or the lower side 1*b* of the main surface of the conductive portion 1, ranges from −20 deg to 20 deg.

Further, in the mode shown in FIGS. 1 and 2, when the dipole antenna 2 has a length $L_A$ in the longitudinal direction (the maximum length in the longitudinal direction), when the conductive portion 1 has a thickness T, and when a radio wave for communication with the external device has a wavelength $\lambda_0$ in the air, the formula of $\lambda_0 \geqq L_A \geqq T$ is established. When the formula of $L_A \geqq T$ is established, it is possible to improve the antenna gain since the dipole antenna 2 is difficult to be completely shaded by the conductive portion 1 as viewed from the communication antenna 6 of an external device in comparison with a case where $L_A$ is smaller than T. When the formula of $L_A \leqq \lambda_0$ is established, it is possible to make the dipole antenna compact.

It is preferred that the formula of $\lambda_0 \geqq L_A \geqq 1.5T$ be established. It is more preferred that the formula of $(\lambda_0/2) \geqq L_A \geqq T$ be established. It is particularly preferred that the formula of $(\lambda_0/2) \geqq L_A \geqq 1.2T$ be established. It is most preferred that the formula of $0.8 \cdot (\lambda_0/2) \geqq L_A \geqq 1.2T$ be established.

In the present invention, when the dipole antenna 2 comprises two radiating conductors, the longitudinal direction of the dipole antenna 2 means a direction, in which an imaginary straight line connecting the centers of the two radiating conductors extends. When the dipole antenna 2 includes a first feed point and a second feed point connected to the first feed point by a single conductor or conductive wire as in a folded antenna, the longitudinal direction of the dipole antenna 2 means a direction, in which the conductor or the conductive wire has the maximum width. The dipole antenna 2 shown in FIGS. 1 and 2 is configured so that each of the two radiating conductors 2*a* and 2*b* comprises a conductor formed in an oval shape, that the minor axis of the oval of the radiating conductor 2*a* and the minor axis of the oval of the radiating conductor 2*b* are in alignment with each other, and that two closest points of the radiating conductor 2*a* and the radiating conductor 2*b* serve as feed points 3*a* and 3*b*.

In the case shown in FIGS. 1 and 2, when the formula of $La=(\lambda_0/2)$ or $La\approx(\lambda_0/2)$ is established, the shortest distance d between each of the peripheral portions of the radiating conductors 2*a* and 2*b* of the dipole antenna 2 and the lateral portion 1*c* of the conductive portion 1 ranges from $(\lambda_0/20)$ to $3\lambda_0$. It is preferred that the shortest distance d is $(\lambda_0/20)$ or longer. In this preferred case, the antenna gain is improved in comparison with a case where the shortest distance d is shorter than $(\lambda_0/20)$. It is preferred that the shortest distance d be $3\lambda_0$ or shorter. In the latter case, it is possible to make the dipole antenna compact in comparison with a case where the shortest distance d is longer than $3\lambda_0$. The shortest distance d more preferably ranges from $(\lambda_0/10)$ to $2\lambda_0$, particularly preferably ranges from $(\lambda_0/10)$ to $1.5\lambda_0$ and most preferably ranges from $(\lambda_0/4)$ to $\lambda_0$.

When the formula of $L_A\neq(\lambda_0/2)$ is established or when the formula of $L_A\approx(\lambda_0/2)$ is not established, it is preferred for the same reasons that the shortest distance range from $(L_A/10)$ to $6L_A$. The shortest distance d more preferably ranges from $(L_A/5)$ to $4L_A$, particularly preferably ranges from $(L_A/5)$ to $3L_A$ and most preferably ranges from $(L_A/2)$ to $2L_A$.

In the case shown in FIGS. 1 and 2, it is preferred that a smaller angle $|\alpha|$ of the angles, at which the longitudinal direction of the dipole antenna 2 intersects with the display screen 4*a*, range from 5 to 90 deg. When the angle $|\alpha|$ is in this range, the antenna gain is improved in comparison with a case where the angle $|\alpha|$ is out of this range. The angle $|\alpha|$ preferably ranges from 10 to 90 deg, particularly preferably ranges from 15 to 90 deg and most preferably ranges from 30 to 90 deg.

(1-2) Wide Angle Mode in First Embodiment

Figure 3:
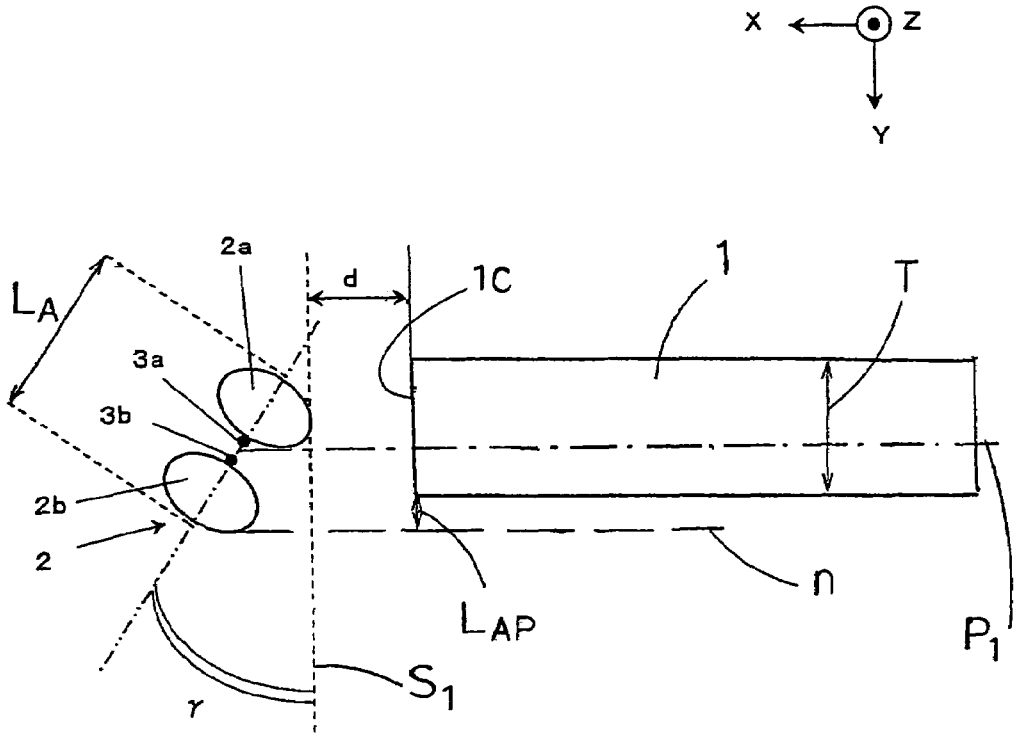
FIG. 3 is a plan view showing the basic structure of the electronic device according to a wide angle mode in the first embodiment of the present invention.

FIG. 3 is a plan view showing the basic structure of the wide-angle mode in the first embodiment. In FIG. 3, the display unit 4 is omitted. In the narrow angle mode in the first embodiment, the disposing angle of the dipole antenna 2 to the display unit is limited by restricting the direction of the imaginary straight line $m_1$ and restricting the position of the imaginary straight line $m_1$. However, the disposing angle of the dipole antenna 2 to the display unit is relaxed in this mode in comparison with the narrow angle mode in the first embodiment since there are no limitations to the direction of the imaginary straight line $m_1$ and to the position of the imaginary straight line $m_1$. Instead, the following limitations are required. The other conditions than the following limitations are the same as those in the narrow angle mode in the first embodiment.

In the wide angle mode in the first embodiment, when it is assumed that there is an imaginary straight line $P_1$, which passes through the center of the dipole antenna 2 and is parallel to the display screen 4*a* of the display unit 4 and is parallel to the upper side or the lower side of the main surface of the conductive portion 1, the dipole antenna 2 is disposed in such a position that the imaginary straight line $P_1$ passes through the lateral portion 1*c* of the conductive portion 1 or has contact with the lateral portion.

In a case where it is assumed that there is a vertical imaginary surface $S_1$, which is perpendicular to the display screen 4*a* of the display unit 4, when a smaller angle of the angles, at which the longitudinal direction of the dipole antenna 2 intersects with the surface $S_1$, is defined as $\gamma$, the formula of $-70\ \text{deg}\leqq 70\ \text{deg}$ is established. When the smaller angle is in the range, the antenna gain is improved in comparison with a case where the angle is out of the range. The smaller angle preferably satisfies the formula of $-50\ \text{deg}\leqq 50\ \text{deg}$, more preferably satisfies the formula of $-40\ \text{deg}\leqq 40\ \text{deg}$, particularly preferably satisfies the formula of $-30\ \text{deg}\leqq 30\ \text{deg}$ and most preferably satisfies the formula of $-20\ \text{deg}\leqq 20\ \text{deg}$.

In a case where it is assumed that there is an imaginary straight line n, which has contact with the farthest leading edge of the dipole antenna 2 projecting from the thickness of the conductive portion 1 in a direction perpendicular to the display screen 4*a* of the display unit, is parallel to the display screen of the display unit 4 and is parallel to the upper side or the lower side of the main surface of the conductive portion 1, when the shortest distance between the lateral portion 1*c* of the conductive portion 1 and the imaginary straight line n is defined as $L_{AP}$, the formula of $0.4\leqq(L_{AP}/L_A)\leqq 2.5$ is established. When the shortest distance is in this range, the antenna gain is improved in comparison with a case where the shortest distance is out of this range. The shortest distance preferably satisfies the formula of $0.7\leqq(L_{AP}/L_A)\leqq 2.0$, more preferably satisfies the formula of $1.0\leqq(L_{AP}/L_A)\leqq 1.8$ and particularly preferably satisfies the formula of $1.2\leqq(L_{AP}/L_A)\leqq 1.6$. It should be noted that when the dipole antenna 2 has farthest leading edges located on both of the front surface side and the rear surface side of the display unit, it is sufficient that either one of the farthest leading edges of the dipole antenna 2 satisfies the conditions stated above.

(2) Now, the second embodiment of the electronic device according to the present invention will be described.

(2-1) Narrow Angle Mode in Second Embodiment

Figure 4:
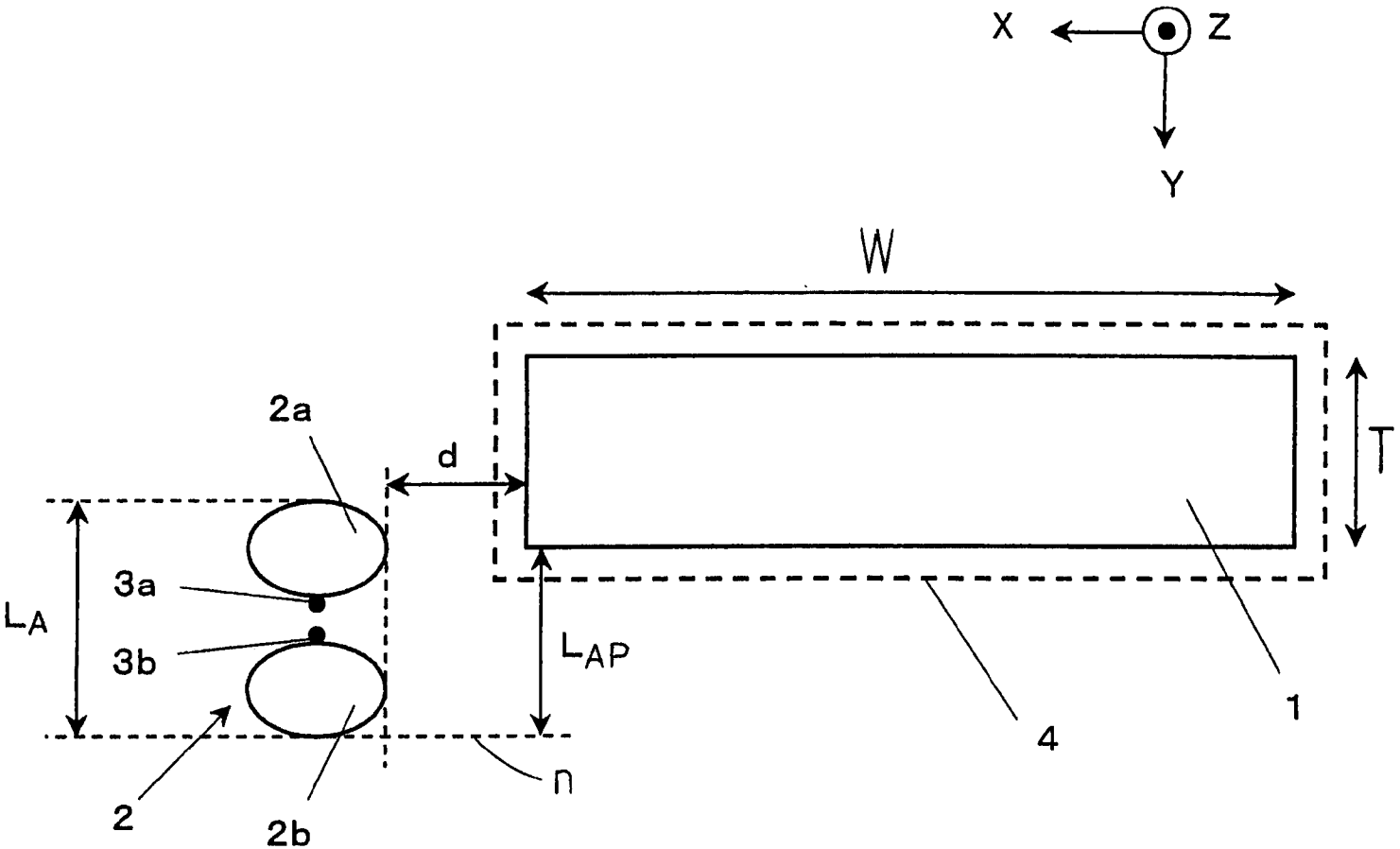
FIG. 4 is a plan view showing the basic structure of the electronic device according to a second embodiment of the present invention.
Figure 5:
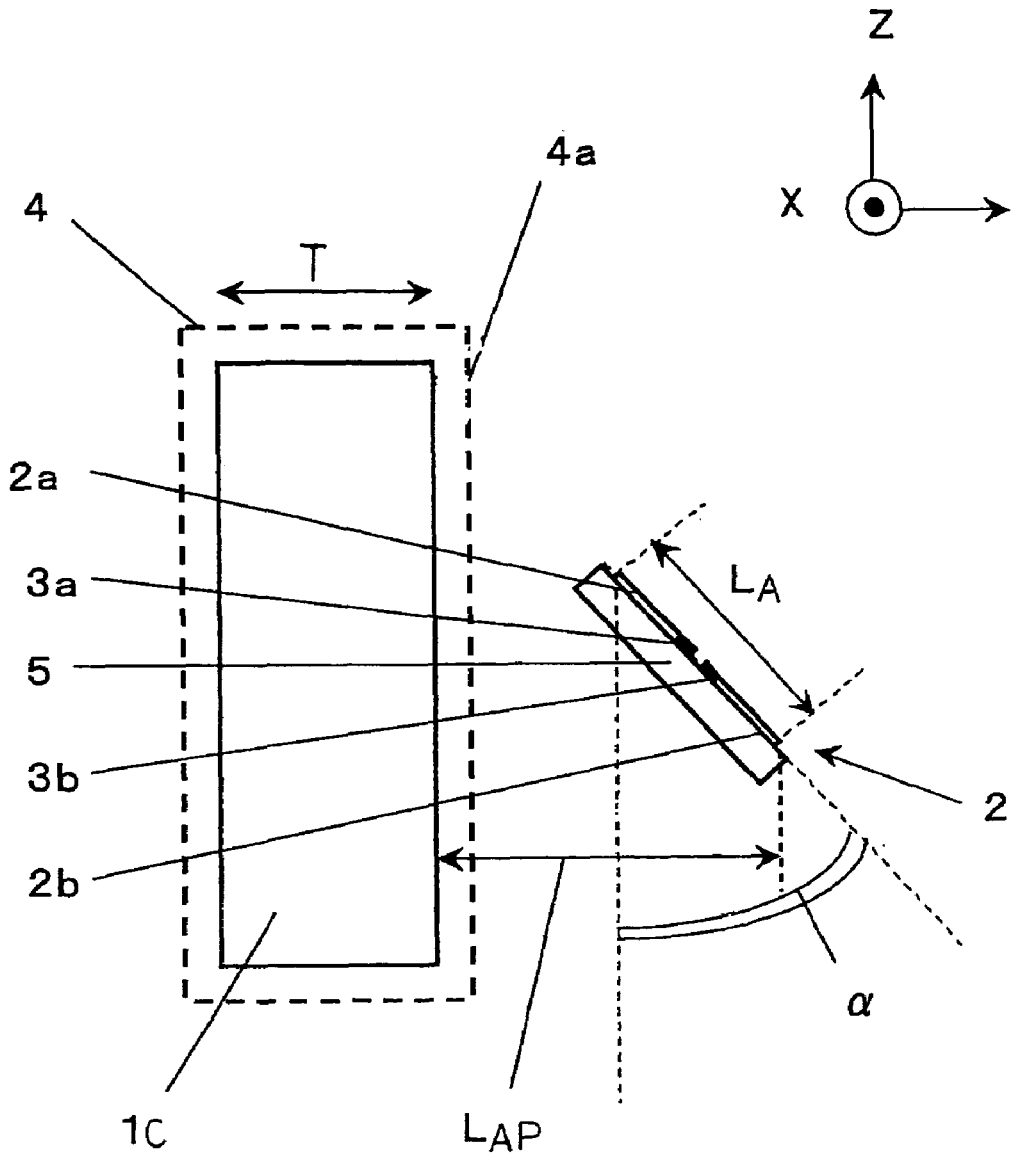
FIG. 5 is a side view of the electronic device according to the second embodiment shown in FIG. 4, as viewed from the dipole antenna.

FIG. 4 is a plan view showing the basic structure of the electronic device according to a narrow angle mode in the second embodiment of the present invention. FIG. 5 is a side view of the electronic device according to the narrow mode in the second embodiment shown in FIG. 4 as viewed from the side of the dipole antenna 2. It should be noted that $L_{AP}$ is shown to be enlarged in the structure shown in FIG. 5 in comparison with the structure shown in FIG. 4. In FIG. 4, the imaginary straight line $m_1$, an imaginary straight line $m_2$ and an imaginary straight line $m_3$ are omitted. It should be noted that FIG. 1 is not only the front view showing the basic structure according to the narrow angle mode in the first embodiment but also a front view showing the basic structure according to the narrow mode in the second embodiment.

In the case shown in FIGS. 1 and 2, the diapole antenna 2 is disposed on the lateral portion 1*c* or in the vicinity of the lateral portion 1*c* of the display unit 4 so that the imaginary straight line $m_1$ passes through the lateral portion 1*c* of the conductive portion 1 or has contact with the lateral portion 1*c*. On the other hand, the case shown in FIGS. 4 and 5 covers not only a case where the imaginary line $m_1$ passes through the conductive portion 1 but also a case where the imaginary line $m_1$ does not pass through the conductive portion 1*c*.

In the case shown in FIGS. 4 and 5, the following formula (1) is satisfied under the condition of $L_A\cdot\sin|\alpha|\leqq T$:

$$0.2\leqq(L_{AP}/L_A)\leqq 2.5 \tag{1}$$

wherein $\sin|\alpha|$ is a value satisfying the formula (1).

$|\alpha|$ is the absolute value of $\alpha$, and therefore, the formula of $\sin|\alpha|\geqq 0$ (zero) is established. When $L_{AP}/L_A$ is in this range, the antenna gain is improved in comparison with a case where $L_{AP}/L_A$ is out of this range. It is preferred from the viewpoint of making the dipole antenna compact that the formula of $(L_{AP}/L_A)\leqq 2.5$ be established. $L_{AP}/L_A$ more preferably satisfies the formula of $0.3 \leqq (L_{AP}/L_A) \leqq 2.0$, particularly preferably satisfies the formula of $0.5 \leqq (L_{AP}/L_A) \leqq 2.0$ and most preferably satisfies the formula of $1.0 \leqq (L_{AP}/L_A) \leqq 1.8$.

The formula of $L_A \cdot \sin|\alpha| \leqq T$ is established. In this case, it is possible to easily obtain the advantage of this mode. It is preferred that the formula of $2L_A \cdot \sin|\alpha| \leqq T$ be established. It is more preferred that $3L_A \sin|\alpha| \leqq T$ be established.

When $(L_{AP}/L_A)$ is less than 0.6, the angle $|\alpha|$ preferably ranges from 5 to 90 deg, more preferably ranges from 10 to 90 deg, particularly preferably ranges from 20 to 90 deg and most preferably ranges from 40 to 90 deg. When $(L_{AP}/L_A)$ is from 0.6 to 0.9, the angle $|\alpha|$ preferably ranges from 30 to 90 deg and more preferably ranges from 40 to 90 deg. When $(L_{AP}/L_A)$ is beyond 0.9, there is no limitation to the angle $|\alpha|$, and the angle $|\alpha|$ preferably ranges from 0 to 90 deg. In these cases, in the viewpoint of making the diapole antenna compact and in consideration of the range of T wherein the advantage of this mode can be easily offered, under the condition of $L_A \cdot \sin|\alpha| \leqq T$, it is preferred that the formula of $2 \cdot L_A \geqq T$ be established, it is more preferred that the formula of $1.5 \cdot L_A \geqq T$ be established, it is particularly preferred that the formula of $1.3 \cdot L_A \geqq T$ be established, and it is most preferred that the formula of $1.2 \cdot L_A \geqq T$ be established.

In the present invention, it is assumed that there is the imaginary straight line $m_2$ which starts at a starting point c as the center of the conductive portion 1, is parallel to the display screen 4*a* of the display unit 4, is parallel to the upper side 1*a* or the lower side 1*b* of the main surface of the conductive portion 1 and extends toward a direction opposite the dipole antenna 2. Even if the communication antenna of an external device is disposed in the extending direction of the imaginary straight line $m_2$, the antenna gain is prevented from being greatly lowered in comparison with a case where the communication antenna 6 of the external device is located in any one of the other directions.

In consideration of the presence of a permissible range, in a case where it is assumed that there is the imaginary straight line $m_3$, which connects between the starting point c and the center of the communication antenna 6 of the external device, when a smaller angle of the angles, at which the imaginary straight line $m_2$ and the imaginary straight line $m_3$ intersect, is defined as $\beta$, even if the communication antenna 6 of the external device is disposed in the range of $-20\text{ deg} \leqq \beta \leqq 20$ deg, in particular $-10\text{ deg} \leqq \beta \leqq 10$ deg, the antenna gain is prevented from being greatly lowered in comparison with a case where the communication antenna 6 of the external device is disposed in the other ranges.

It should be noted that although the imaginary straight line $m_1$ and the imaginary straight line $m_2$ are out of alignment with each other, the imaginary straight line $m_1$ and the imaginary straight line $m_2$ are confirmed with each other on the right side of the starting point c in this figure as viewed toward this figure.

(2-2) Wide Angle Mode in Second Embodiment

Figure 6:
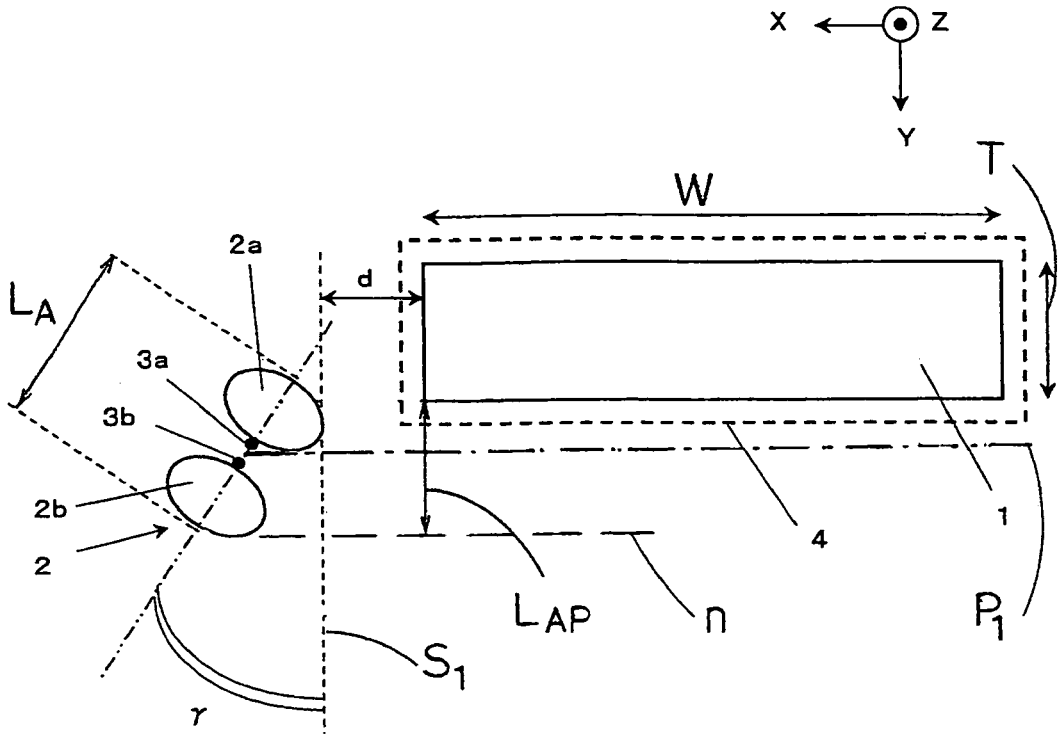
FIG. 6 is a plan view showing the basic structure of the electronic device according to a wide angle mode in the second embodiment.

FIG. 6 is a plan view showing the basic structure according to a wide angle mode in the second embodiment. In the narrow angle mode in the second embodiment, the disposing angle of the dipole antenna 2 to the display unit is limited by restricting the direction of the imaginary straight line $m_1$ and restricting the position of the imaginary straight line $m_1$. However, the disposing angle of the dipole antenna 2 to the display unit 4 is relaxed in this mode in comparison with the narrow angle mode in the second embodiment since there are no limitations to the direction of the imaginary straight line $m_1$ and to the position of the imaginary straight line $m_1$. Instead, the following limitations are required. The other conditions than the following limitations are the same as those in the narrow angle mode in the second embodiment.

In this mode, the formula of $-70\text{ deg} \leqq \gamma \leqq 70$ deg is established. When the disposing angle is in this range, the antenna gain is improved in comparison with a case where the disposing angle is out of this range. It is preferred that the formula of $-50\text{ deg} \leqq \gamma \leqq 50$ deg be established, it is more preferred that $-40\text{ deg} \leqq \gamma \leqq 40$ deg be established, it is particularly preferred that $-30\text{ deg} \leqq \gamma \leqq 30$ deg be established, and it is most preferred that the formula of $-20\text{ deg} \leqq \gamma \leqq 20$ deg be established.

The formula of $0.7 \leqq (L_{AP}/L_A) \leqq 2.2$ is established. When $L_{AP}/L_A$ is in this range, the antenna gain is improved in comparison with a case where $L_{AP}/L_A$ is out of this range. Further, when the formula of $(L_{AP}/L_A) \leqq 2.2$ is established, it is possible to make the diapole antenna compact. $L_{AP}/L_A$ preferably satisfies the formula of $1.0 \leqq (L_{AP}/L_A) \leqq 2.0$ and particularly satisfies the formula of $1.0 \leqq (L_{AP}/L_A) \leqq 1.8$. It should be noted that when the diapole antenna 2 has furthest leading edges located on both of the front surface side and the rear surface side of the display unit, it is sufficient that either one of the surface leading edges of the diapole antenna 2 satisfies the conditions stated above.

When $(L_{AP}/L_A)$ is less than 0.6, the angle $|\alpha|$ preferably ranges from 5 to 90 deg, more preferably ranges from 10 to 90 deg, particularly preferably ranges from 20 to 90 deg and most preferably ranges from 40 to 90 deg. When $(L_{AP}/L_A)$ ranges from 0.6 to 0.9, the angle $|\alpha|$ preferably ranges from 30 to 90 deg and more preferably ranges from 40 to 90 deg. When $(L_{AP}/L_A)$ is beyond 0.9, there is no limitation to the angle $|\alpha|$, and the angle $|\alpha|$ is preferably from 0 to 90 deg. In these cases, from the viewpoint of making the diapole antenna compact and in consideration of the range of T wherein the advantage of this mode can be easily offered, under the condition of $L_A \cdot \sin|\alpha| \leqq T$, it is preferred that the formula of $2 \cdot L_A \geqq T \geqq 0.5 \cdot L_A$ be established, it is more preferred that $1.5 \cdot L_A \geqq T \geqq 0.75 \cdot L_A$ be established, it is particularly preferred that the formula of $1.3 \cdot L_A \geqq T \geqq 0.7 \cdot L_A$ be established, and it is most preferred that the formula $1.2 \cdot L_A \geqq T \geqq 0.8 \cdot L_A$ be established.

When it is assumed that there is an imaginary straight line $P_1$, which is parallel to the display screen 4*a* of the display unit 4 and is parallel to the upper side or the lower side of the main surface of the conductive portion 1, it is preferred from the viewpoint of improving the antenna gain that the diapole antenna be disposed at such a position that the imaginary straight line $P_1$ does not pass through the lateral portion 1*c* of the conductive portion 1. It should be noted that the diapole antenna 2 may be disposed at such a position that the imaginary straight line $P_1$ passes through the lateral portion 1*c* of the conductive portion 1 or has contact with the lateral portion 1*c*.

It is preferred that the formula of $L_A \leqq T$ be established. In this case, the advantage of this mode can be easily offered. It is more preferred that the formula of $2L_A \leqq T$ be established, and it is particularly preferred that the formula of $3L_A \leqq T$ be established.

When the formula of $\lambda_0 \geqq L_A \geqq T$ is established, the angle $|\alpha|$ preferably ranges from 5 to 90 deg. When the angle $|\alpha|$ is in this range, the antenna gain is improved in comparison with a case where the angle $|\alpha|$ is out of this range. The angle $|\alpha|$ more preferably ranges from 10 to 90 deg, particularly preferably ranges from 15 to 90 deg and most preferably ranges from 30 to 90 deg.

(2-3) Condition Common to Narrow Angle Mode in Second Embodiment and Wide Angle Mode in Second Embodiment From the viewpoint of making the diapole antenna compact, it is preferred that the range of T preferably satisfies the formula $T \leqq 4\lambda_0$. The range of T more preferably satisfies the formula of $T \leqq 3\lambda_0$, more preferably satisfies the formula of $T \leqq 2\lambda_0$ and most preferably satisfies the formula of $T \leqq 1.5\lambda_0$.

(3) Common Conditions in the Present Invention

In the present invention, it is preferred that at least one side among the four sides forming the rectangular or substantially rectangular shape of the conductive portion 1 have a greater length than $L_A$. Under this condition, the antenna gain is likely to be favorably affected in the communication between the dipole antenna 2 and the communication antenna 6 of the external device, and the dipole antenna 2 can be easily mounted to the display unit since the dipole antenna is made smaller than the display unit. The at least one side has a greater length than preferably the wavelength $\lambda_0$, more preferably $6L_A$, particularly preferably $10L_A$ and most preferably $20L_A$. From the viewpoint of the display unit being used in a room, the at least one side has a maximum length, which is smaller than preferably $100L_A$ and more preferably $50L_A$. The diapole antenna is mounted to the display unit, being adjusted so to have a proper location and a proper inclination.

In the present invention, it is preferred from the viewpoint of making the diapole antenna 2 compact that the diapole antenna 2 be disposed at a such position that the top end of the diapole antenna 2 does not project to a higher level than the top end of the conductive portion and that the bottom end of the diapole antenna 2 does not project to a lower level than the bottom end of the conductive portion.

With regard to T, T is preferably 0.5 mm or above, particularly preferably 1 mm or above in the modes where no lower limit is specified. When the conductive portion 1 comprises a metal casing, a driving circuit for display, a peripheral circuit for display or the like, the conductive portion is required to have a certain level of thickness in terms of strength and performance.

As stated above, it is preferred from the viewpoint of making the diapole antenna compact and another factor that the diapole antenna 2 according to the present invention have the radiating conductors partly or entirely disposed on or in the dielectric substrate. In this case, the wavelength is shortened to make $L_A$ short by the dielectric substrate.

It is preferred from the viewpoint of making the diapole antenna 2 compact and of causing the diapole antenna 2 to resonate with a communication frequency to improve the antenna gain that $L_A$ range from $0.4\cdot((\lambda_0)/2)$ to $(\lambda_0)/2$. $L_A$, more preferably ranges from $0.4\cdot((\lambda_0)/2)$ to $0.8\cdot((\lambda_0)/2)$ and particularly preferably ranges from $0.4\cdot((\lambda_0/2)$ to $0.6\cdot((\lambda_0)/2)$.

It is preferred that the present invention be applied to a frequency band of from 1 to 30 GHz or a frequency band of from 30 to 300 GHz. In other words, it is preferred that the frequency used for communication with an external communication device be at least one frequency of from 1 to 300 GHz. It is more preferred that the present invention be applied to a frequency of from 1 to 11 GHz. It is particularly preferred that the frequency used for communication is at least one frequency of from 1 to 11 GHz. It is most preferred that the present invention be applied to a frequency band of from 3 to 11 GHz.

When a radio wave, which is used for communication with the external device, has a frequency of from 3 to 11 GHz, it is preferred that the diapole antenna 2 have a band width of from 2.4 to 13.2 GHz. The band width more preferably ranges from 2.7 to 12.1 GHz, particularly preferably ranges from 2.85 to 11.55 GHz and most preferably ranges from 3 to 11 GHz.

From this point of view, it is preferred that the diapole antenna 2 have a broadband property. In this case, it is possible to smoothly perform communication in the present invention. In a case where the bandwidth represents a frequency range lower than a VSWR of 2 in terms of the frequency-VSWR (Voltage Standing Wave Ratio) characteristic of the dipole antenna 2, when the frequency, at which VSWR is 2 on a low side, is defined as $f_L$, and when a higher frequency, at which VSWR is 2 on a high side, is defined as $f_H$, the dipole antenna 2 is supposed to have such a broadband property as long as the operating frequency of the antenna conductors is set at a value of from $f_L$ to $f_H$.

In the present invention, the conductive portion 1 comprises one selected from a metal casing, a driving circuit for display and a peripheral circuit for display. The conductive portion 1 may be formed in a rectangular parallelepiped shape, a substantially rectangular parallelepiped shape, a plate shape, a substantially plate shape, a casing shape, a substantially casing shape, a shape regarded as being equivalent in an electrical sense to a vessel shape comprising a frame with a bottom plate disposed thereon or the like. The center of the conductive portion 1 means the center of gravity of the conductive portion 1 when the conductive portion is formed in a rectangular parallelepiped shape, a substantially rectangular parallelepiped shape, a plate shape, a substantially plate shape, a casing shape, or a substantially casing shape. When the conductive portion 1 is formed in a vessel shape comprising a frame with a bottom plate disposed thereon, the center of the conductive portion 1 means the center of gravity of a casing having the equivalent dimensions as the vessel shape. It should be noted that when the conductive portion 1 is formed in a vessel shape comprising a frame with a bottom plate disposed thereon, the width of the frame perpendicular to the bottom plate is the thickness T of the conductive portion 1. The conductive portion 1 may have at least one hole formed therein.

In the present invention, when the communication antenna 6 of the external device comprises an antenna including a single feeding point for a radiating conductor, the center of the communication antenna means the feeding point for the radiating conductor, and when the communication antenna of the external device comprises an antenna including two feeding points as in the diapole antenna 2, the center of the communication antenna means the center between the two feeding points. In the present invention, examples of the display unit 1 include a liquid crystal display unit and a plasma display unit. However, the present invention is not limited to such display units. There is no limitation to the display unit 1 as long as the display unit has the conductive portion 1 partially or entirely disposed thereon. Examples of the electronic device include a TV set and a personal computer. However, there is no limitation to the electronic device as long as the electronic device includes a display unit.

The diapole antenna 2 is mechanically mounted and disposed on the lateral portion of the display unit 4 or in the vicinity of the lateral portion, normally using a mechanical means, such as a metal fitting. However, the mounting of the diapole antenna is not limited to this manner, and the diapole antenna may be provided by a chemical means, such as an adhesive. When a communication module including a diapole antenna is used, the communication module may be mounted and disposed on the lateral portion of the display unit 4 or in the vicinity of the lateral portion.

It is preferred that a rotary means be used to dispose the diapole antenna 2 on the display unit 4 in order to be capable of modifying $\alpha$ and $\gamma$. In this case the communication characteristics can be improved, modifying $\alpha$ and $\gamma$, respectively.

EXAMPLE

Now, the present invention will be described, based on examples. It should be noted that the present invention is not limited to these examples. It is understood that changes and variations may be made in the present invention as long as such changes or variations do not depart from the spirit of the present invention. Now, the examples will be described in detail, referring to the accompanying drawings.

Now, the specifications common to the respective examples will be described. In each of the examples described below, the wavelength of a radio wave for communication is set at 3 GHz ($\lambda_0$=100 mm). The diapole antenna 2 comprises a broadband antenna, which is set at $f_L$=3 GHz and $f_H$=15 GHz in terms of frequency.

The radiating conductors 2*a* and 2*b* of the diapole antenna 2 are set so that each major-axis radius is 18.3 mm, each minor-axis radius is 12.0 mm and $L_A$ is 48 mm. Further, the diapole antenna 2 is disposed so that the imaginary straight line $m_1$ is parallel to the display screen 4*a* to the display unit 4 and is parallel or substantially parallel to the upper side 1*a* or the lower side 1*b* of the main surface of the conductive portion.

Figure 19:
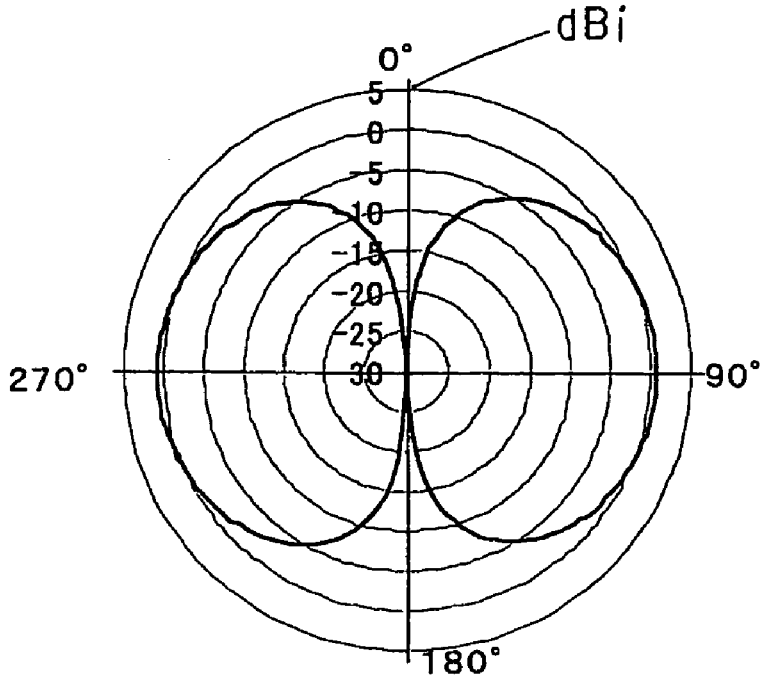
FIG. 19 is the directivity pattern in the dipole antenna in the Z-X plane in the examples.
Figure 20:
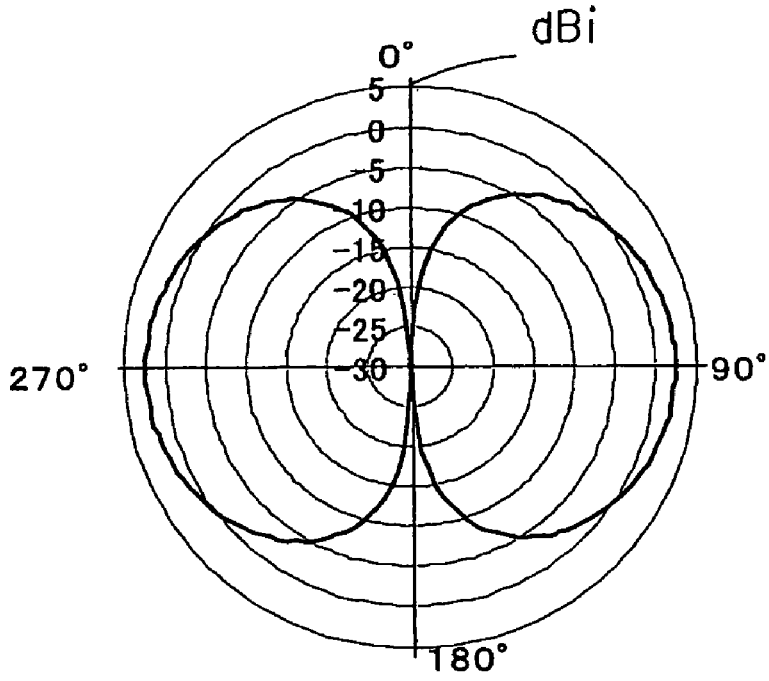
FIG. 20 is the directivity pattern of the dipole antenna in the Y-Z plane in the examples.
Figure 21:
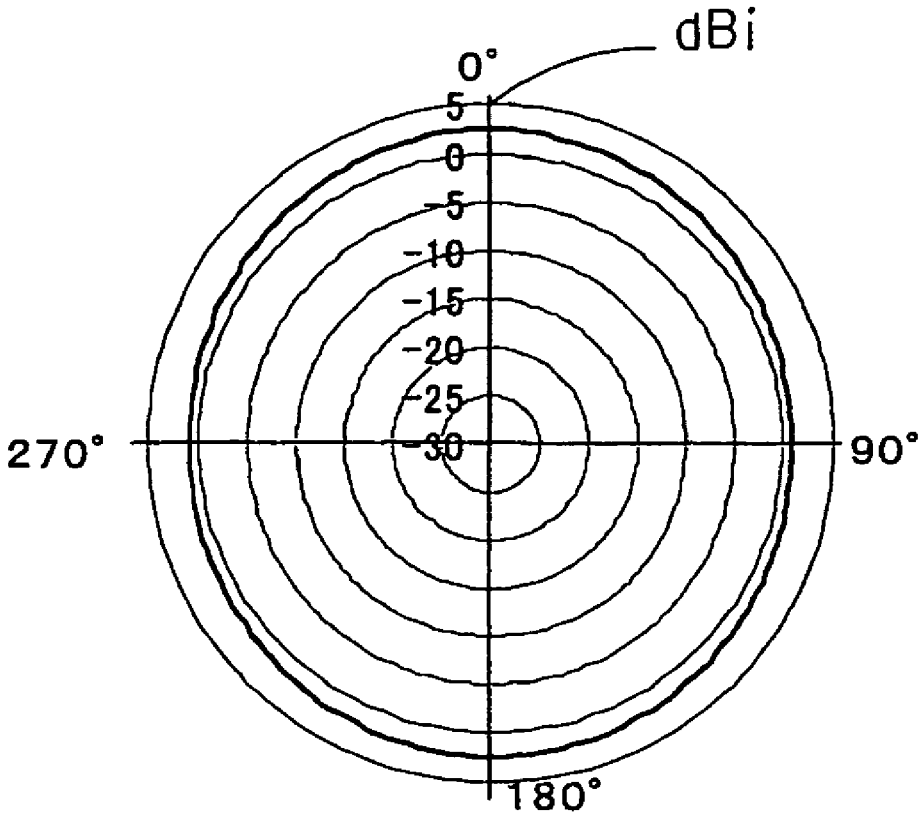
FIG. 21 is the directivity pattern in the dipole antenna in the X-Y plane in the examples.

It is assumed that a radio wave radiated from the diapole antenna (aerial conductors) is received by the communication antenna 6 of an external device. The diapole antenna 2 has directivities shown in FIGS. 19 to 21. FIG. 19 shows the directivity of the diapole antenna 2 in the Z-X plane, FIG. 20 shows the directivity of the diapole antenna 2 in the Y-Z plane and FIG. 21 is the directivity of the diapole antenna 2 in the X-Y plane. The angles shown in FIGS. 19 and 20 are calibrated, based on the Z axis. The angles shown in FIG. 21 are calibrated, based on the Y axis. In FIGS. 19 to 21, the unit of the directivities is dBi.

The characteristics shown in the following respective figures are all represented by electromagnetic simulation according to the moment method (calculated values). The characteristics shown in the respective figures are represented by adopting average values of the antenna gain, which are obtained by disposing the communication antenna 6 of the external device so that the plane defined by the imaginary straight line $m_2$ and the imaginary straight line $m_3$ is perpendicular to the display screen 4*a*, i.e., the plane defined by the imaginary straight line $m_2$ and the imaginary straight line $m_3$ is parallel to the X-Y plane, and by satisfying the formula of $-20 \text{ deg} \leqq \beta \leqq 20$ deg. In each of the following respective examples, it is assumed that the dipole antenna 2 is mounted to the lateral side of the display unit or in the vicinity of the lateral side at a central position in the vertical direction of the display unit.

Example 1

Figure 7:
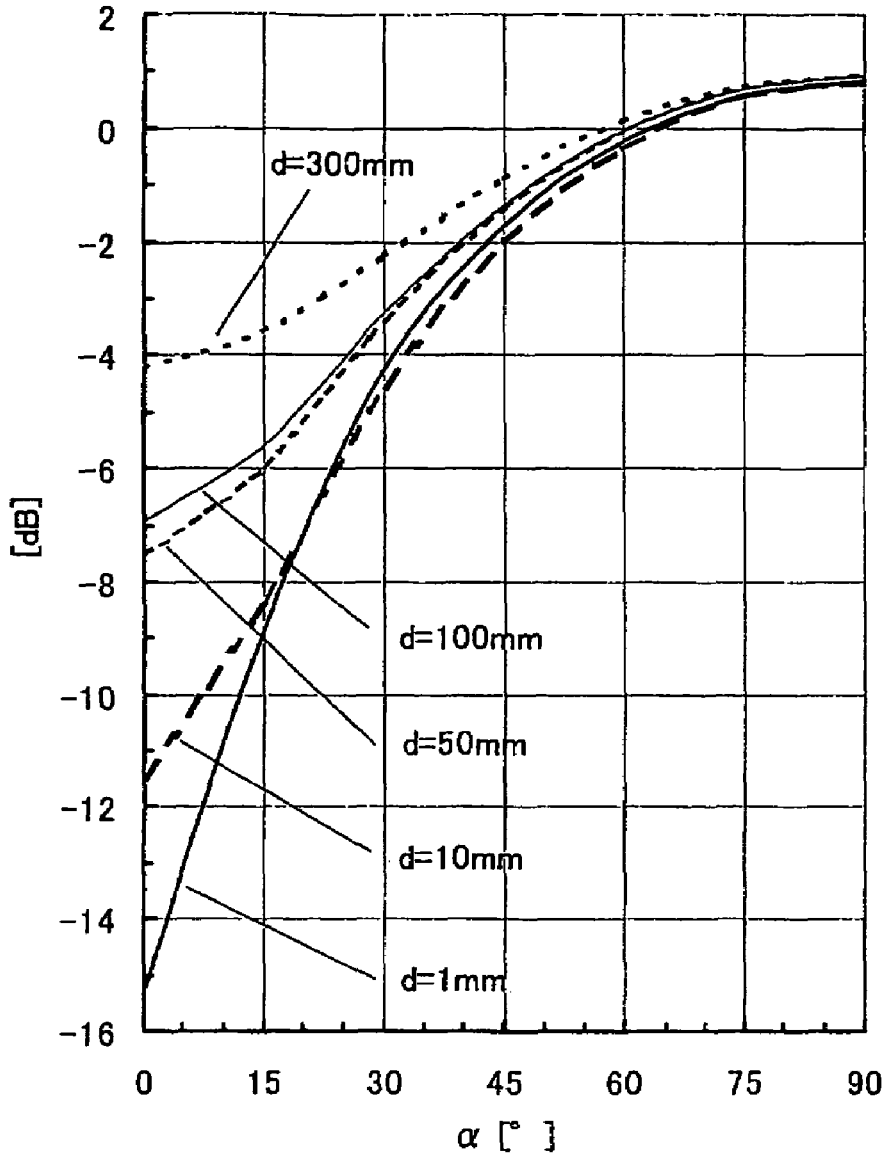
FIG. 7 is a graph showing curves of antenna gain-$\alpha$ characteristics wherein d is modified in the range of from 1 to 300 mm, respectively, in Example 1.
Figure 8:
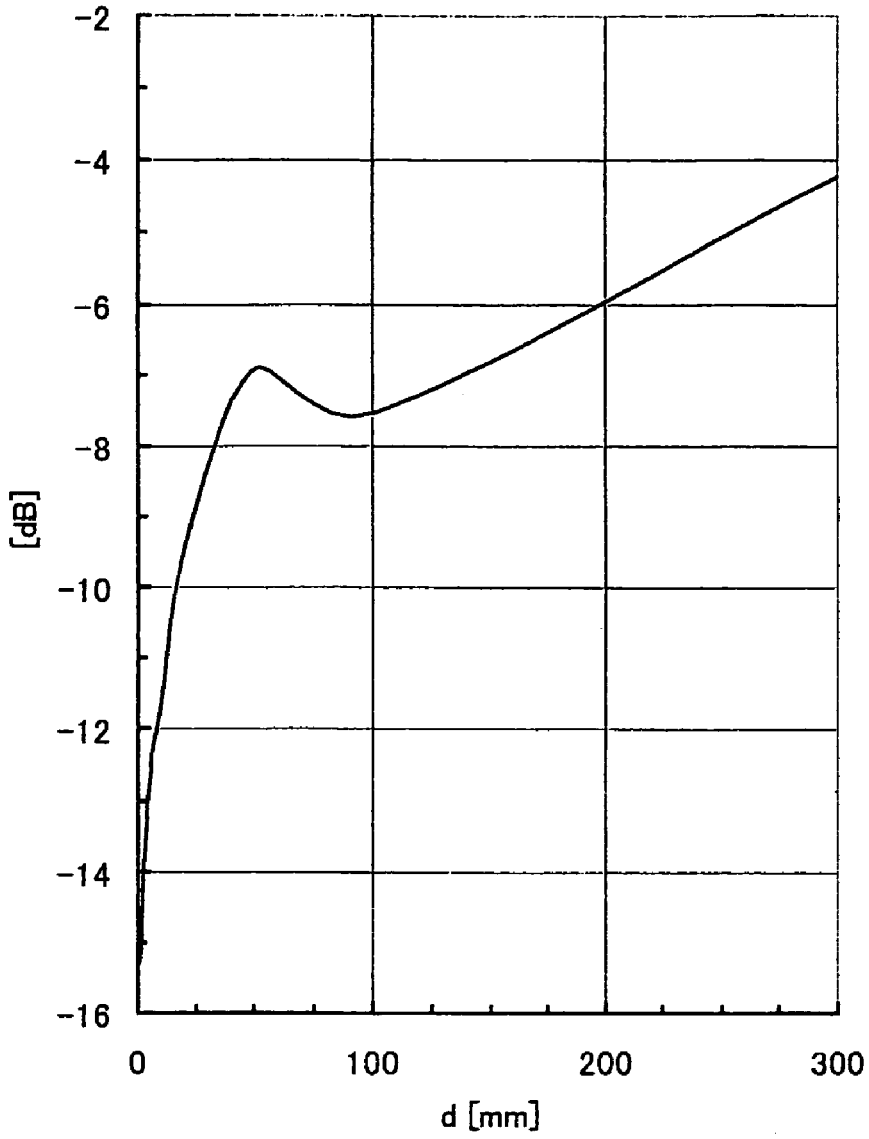
FIG. 8 is a graph showing the curve of an antenna gain-d characteristic wherein $\alpha$ is set at 0 deg in Example 1.

It is assumed that an electronic device (according to the narrow angle mode in the first embodiment) as shown in FIGS. 1 and 2 is used. Specific dimensions are listed below. FIG. 7 shows antenna gain-α characteristics, which are obtained when modifying d in the range of from 1 to 300 mm. FIG. 8 shows antenna gain –d characteristics, which are obtained when α is set at 0 deg.

| | |
|---|---|
| W | 330 mm (3.3$\lambda_0$) |
| H | 260 mm (2.6$\lambda_0$) |
| T | 1 mm |

Example 2 (Comparative Example)

Figure 9:
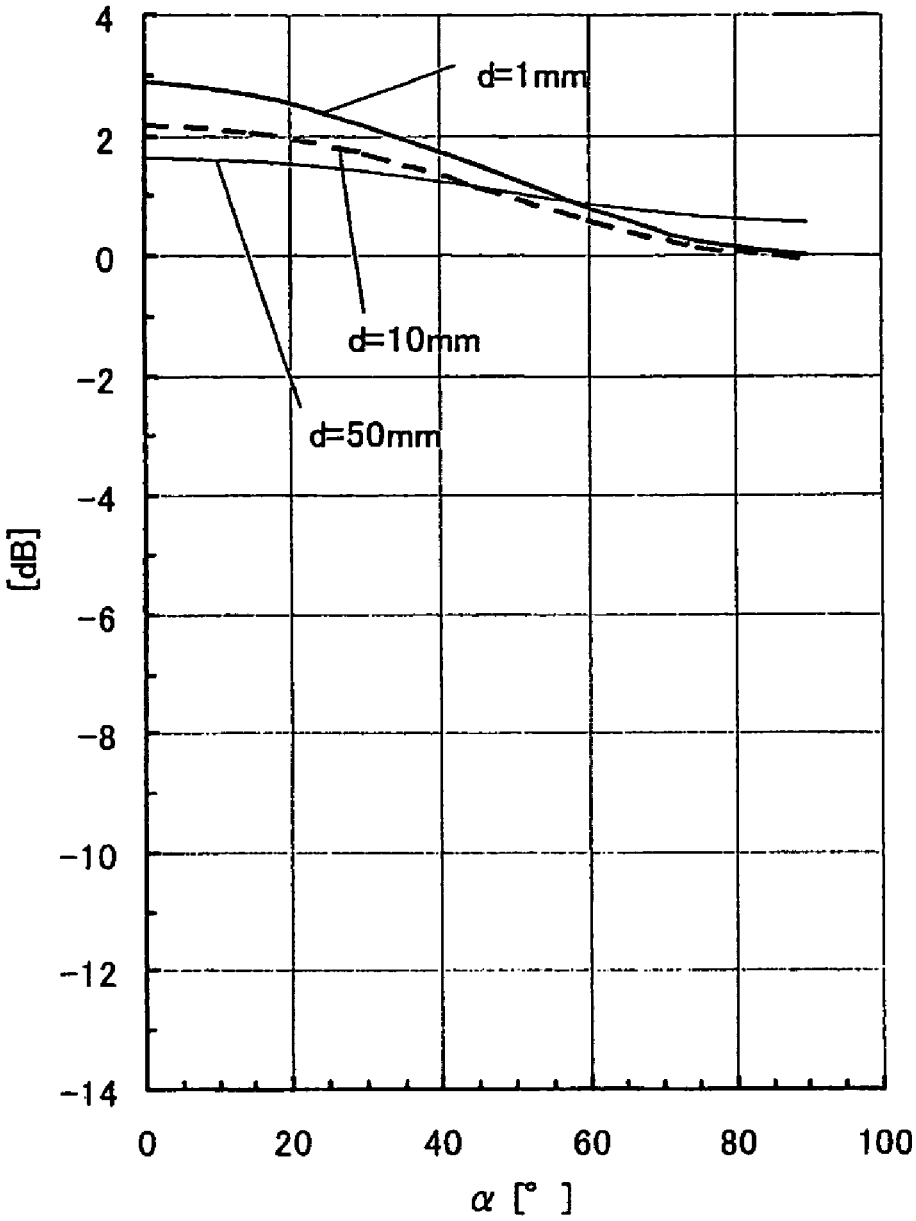
FIG. 9 is a graph showing curves of antenna gain-$\alpha$ characteristics wherein d is modified to 1 mm, 10 mm and 100 mm, respectively, in Example 2.

It is assumed that an electronic device (according to a comparative example corresponding to the narrow angle mode in the first embodiment) as shown in FIGS. 1 and 2 is used. Specific dimensions are listed below. FIG. 9 shows antenna gain-α characteristics which are obtained when modifying d to 1 mm, 10 mm and 50 mm.

| | |
|---|---|
| W | 25 mm (0.25$\lambda_0$) |
| H | 25 mm (0.25$\lambda_0$) |
| T | 1 mm |

Example 3

It is assumed that an electronic device (according to an example common to the narrow angle mode in the second embodiment and the wide angle mode in the second embodiment) as shown in FIGS. 4 and 5 is used.

Figure 10:
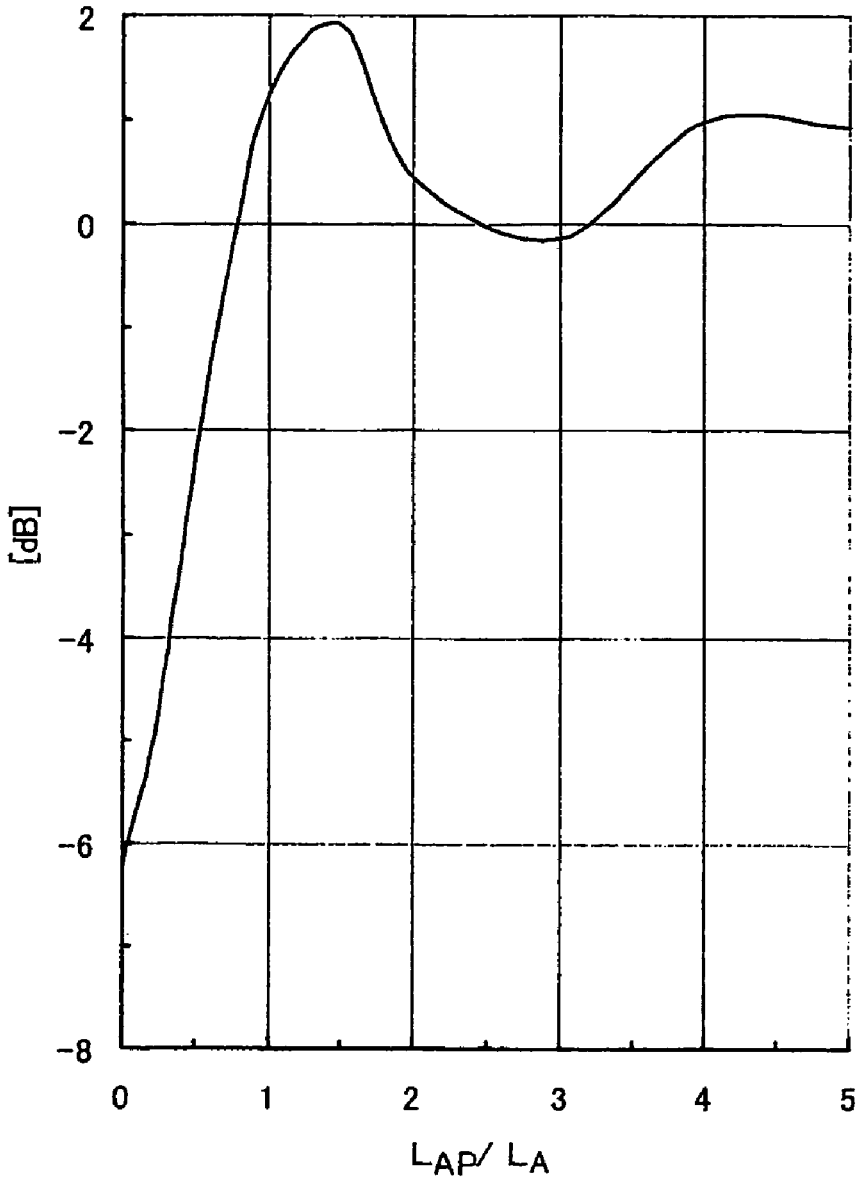
FIG. 10 is a graph showing the curve of an antenna gain-($L_{AP}/L_A$) characteristic wherein $\alpha$ is set at 90 deg in Example 3.

Specific dimensions are listed below. FIG. 10 shows antenna gain-($L_{AP}/L_A$) characteristics, which are obtained by setting α at 90 deg.

| | |
|---|---|
| W | 330 mm (3.3$\lambda_0$) |
| H | 260 mm (2.6$\lambda_0$) |
| T | 50 mm (0.5$\lambda_0$) |

Example 4

It is assumed that an electronic device (according to an example common to the narrow angle mode in the first embodiment, the wide angle mode in the first embodiment, the narrow angle mode in the second embodiment and the wide angle mode in the second embodiment) as shown in FIGS. 1, 2, 3, 4, 5 and 6 is used. Specific dimensions are listed below. The diapole antenna 2 is disposed so that the imaginary straight line $m_1$ has contact with the lateral portion 1*c* of the conductive portion 1. In other words, the diapole antenna 2 is disposed so that ($L_{AP}/L_A$) is set at 0.5 when α is 90 deg.

Figure 11:
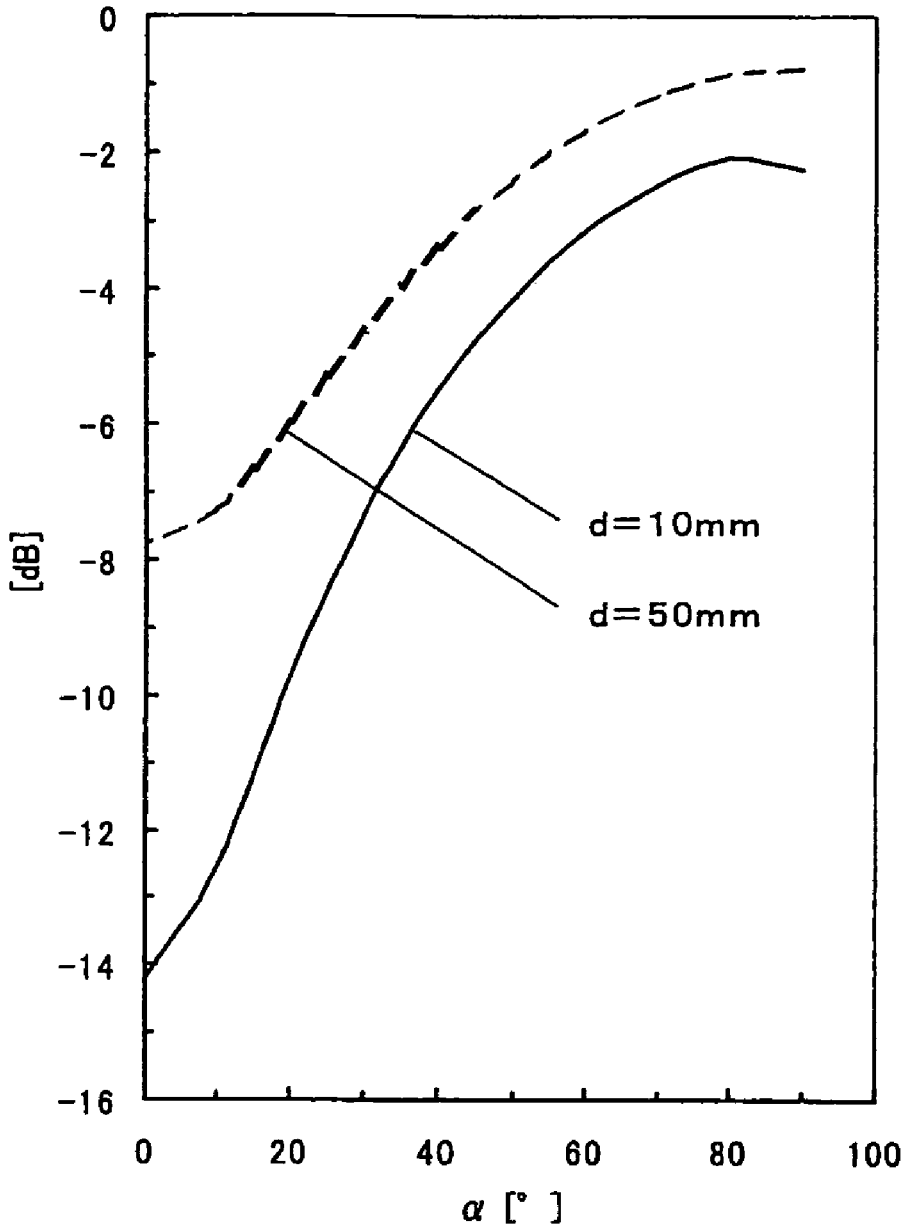
FIG. 11 is a graph showing curves of antenna gain-$\alpha$ characteristics wherein d is set at 50 mm and 10 mm, respectively, with $\alpha$ being modified in Example 4.

FIG. 11 shows antenna gain-α characteristics, which are obtained by modifying α with respect to the imaginary straight line $m_1$ of the diapole antenna 2 when d is set at 10 mm and 50 mm, respectively.

Figure 12:
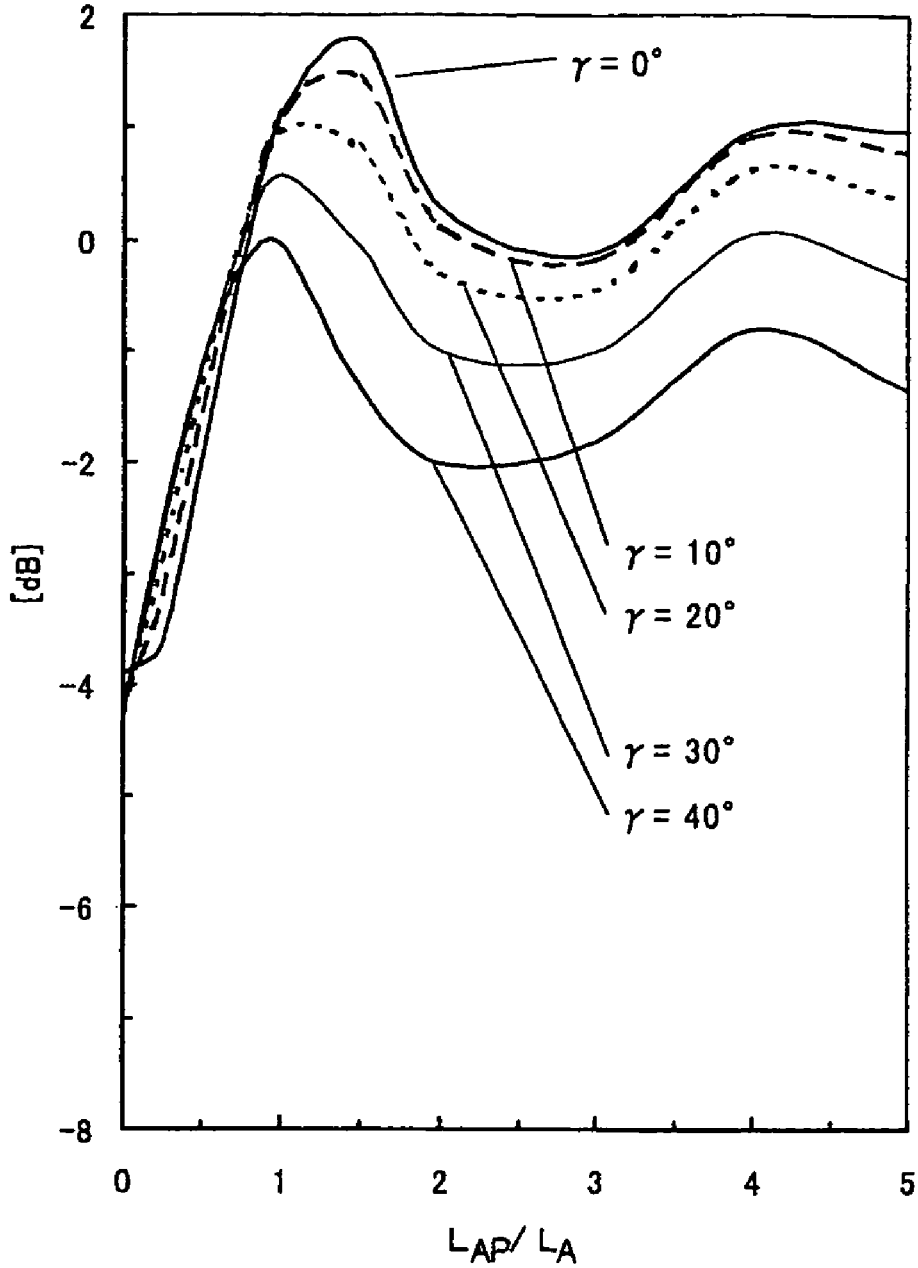
FIG. 12 is a graph showing curves of antenna gain-$\gamma$ characteristics wherein $\alpha$ is set at 90 deg with $\gamma$ (positive) being modified in Example 4.
Figure 13:
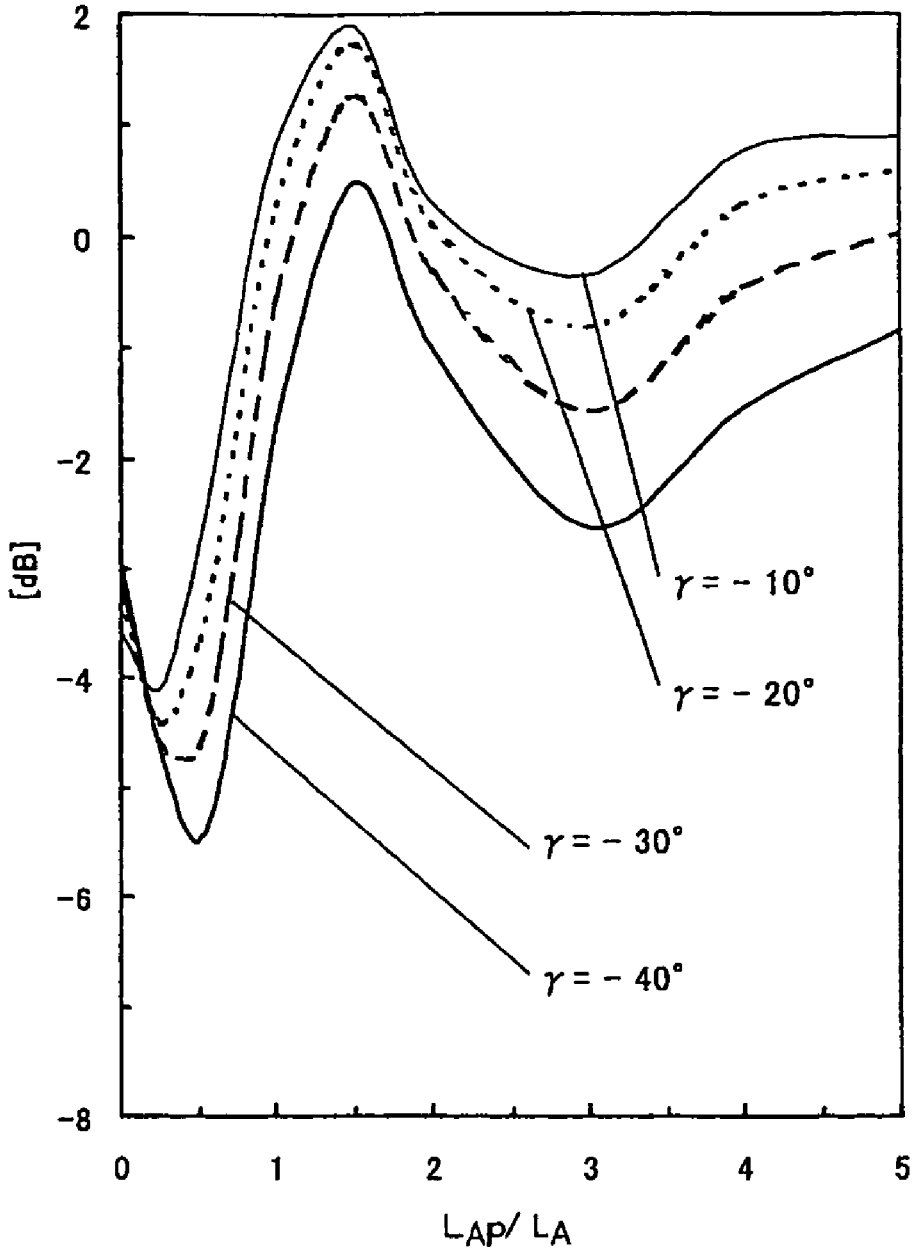
FIG. 13 is a graph showing curves of antenna gain-$\gamma$ characteristics wherein $\alpha$ is set at 90 deg with $\gamma$ (negative) being modified in Example 4.

FIGS. 12 and 13 show antenna gain-γ characteristics, which are obtained by modifying γ, when α is set at 90 deg. In FIGS. 12 and 13, when γ is modified, α is kept at 90 deg, and d is kept at 10 mm. As γ is modified, the center of the diapole antenna moves.

Figure 14:
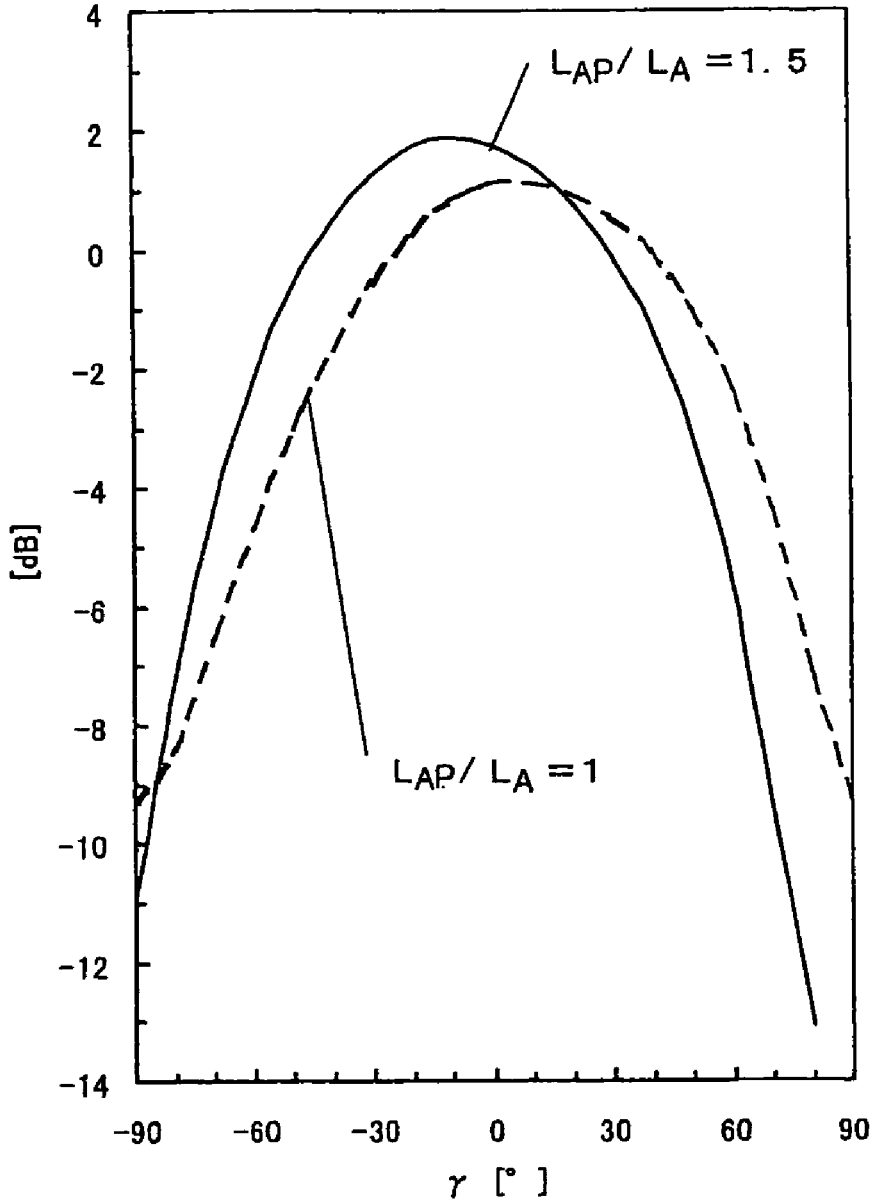
FIG. 14 is a graph showing curves of antenna gain-$\gamma$ characteristics wherein ($L_{AP}/L_A$) is 1.0 and 1.5, respectively, in Example 4.

Under these conditions, the imaginary straight line $P_1$ passes through the lateral portion 1*c* of the conductive portion 1 in the other cases and does not pass through the lateral side in some cases, depending on the values of γ. FIG. 14 shows antenna gain-γ characteristics, which are obtained when ($L_{AP}/L_A$) is set at 1.0 and 1.5, respectively.

| | |
|---|---|
| W | 330 mm (3.3$\lambda_0$) |
| H | 260 mm (2.6$\lambda_0$) |
| T | 40 mm (0.4$\lambda_0$) |

Example 5

It is assumed that an electronic (according to an example common to the narrow angle mode in the second embodiment and the wide angle mode in the second embodiment) device as shown in FIGS. 1, 2, 3, 4, 5 and 6 is used. Specific dimensions are listed below. The diapole antenna 2 is disposed so that the imaginary straight line $m_1$ has contact with the lateral portion 1*c* of the conductive portion. In other words, the diapole antenna 2 is disposed so that ($L_{AP}/L_A$) is set at 0.5 when $\alpha$ is set at 90 deg.

Figure 15:
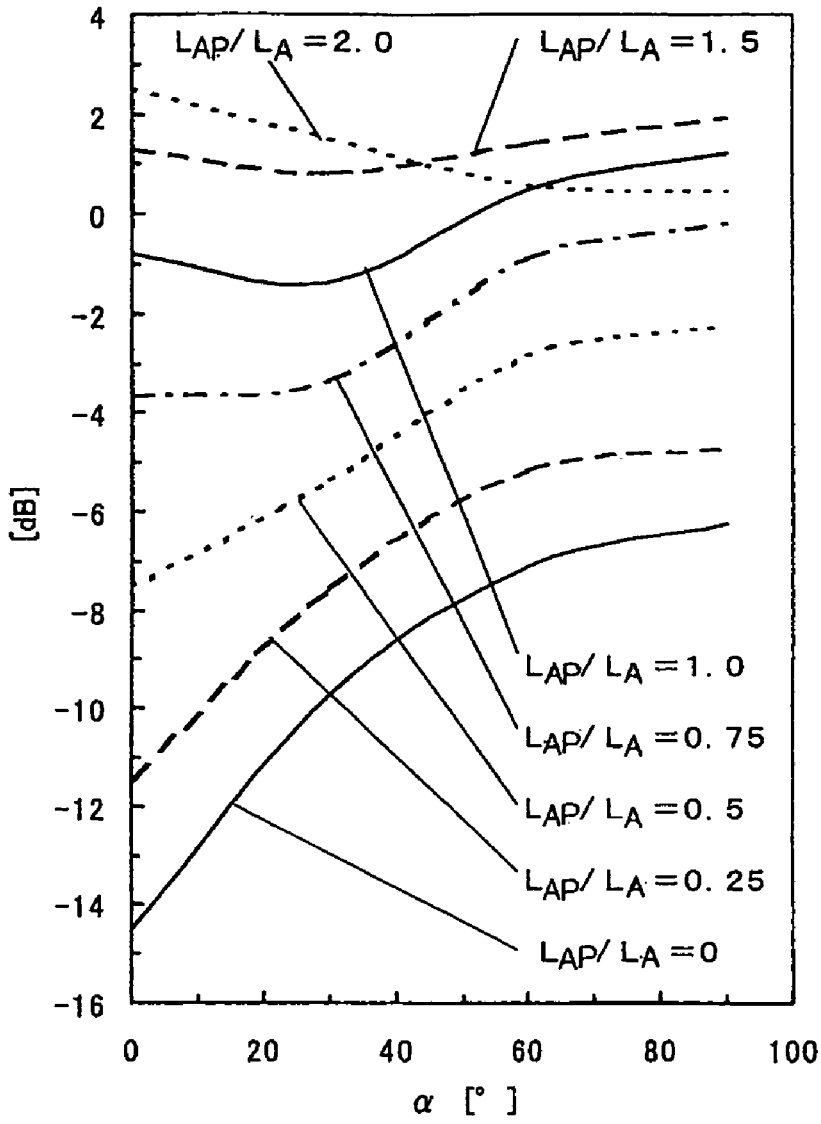
FIG. 15 is a graph showing curves of antenna gain-$\alpha$ characteristics wherein d is set at 10 mm, and ($L_{AP}/L_A$) is measured by plural samplings with $\alpha$ being modified in Example 5.

FIG. 15 shows antenna gain-$\alpha$ characteristics, which are obtained by modifying $\alpha$ with respect to the imaginary straight line $m_1$ of the diapole antenna 2 when d is set at 10 mm, when $\gamma$ is set at 0 deg and when $L_{AP}/L_A$ is measured by plural sampling. On the assumption that in a case where either one of the left side and the right side of the lateral portion 1*c* of the conductive portion 1 is defined as a reference side (for example, the right side is defined as a reference side in the structure shown in FIG. 5), when the imaginary straight line $m_1$ does not pass through the lateral portion 1*c* of the conductive portion 1, the distance between the reference side and the imaginary straight line $m_1$ is indicated by "+" (positive), while when the imaginary straight line $m_1$ passes through the lateral portion 1*c* of the conductive portion 1, the distance between the reference side and the imaginary straight line $m_1$ is indicated by "−" (negative), the distance between the reference side and the imaginary straight line $m_1$ is shown with respect to respective values of $L_{AP}/L_A$ in Table 1.

TABLE 1

| $L_{AP}/L_A$ | Distance between reference side and imaginary straight line $m_1$ (mm) |
|---|---|
| 0 (zero) | −24 |
| 0.25 | −12 |
| 0.5 | 0 (zero) |
| 0.75 | +12 |
| 1.0 | +24 |
| 1.5 | +48 |
| 2.0 | +72 |

Figure 16:
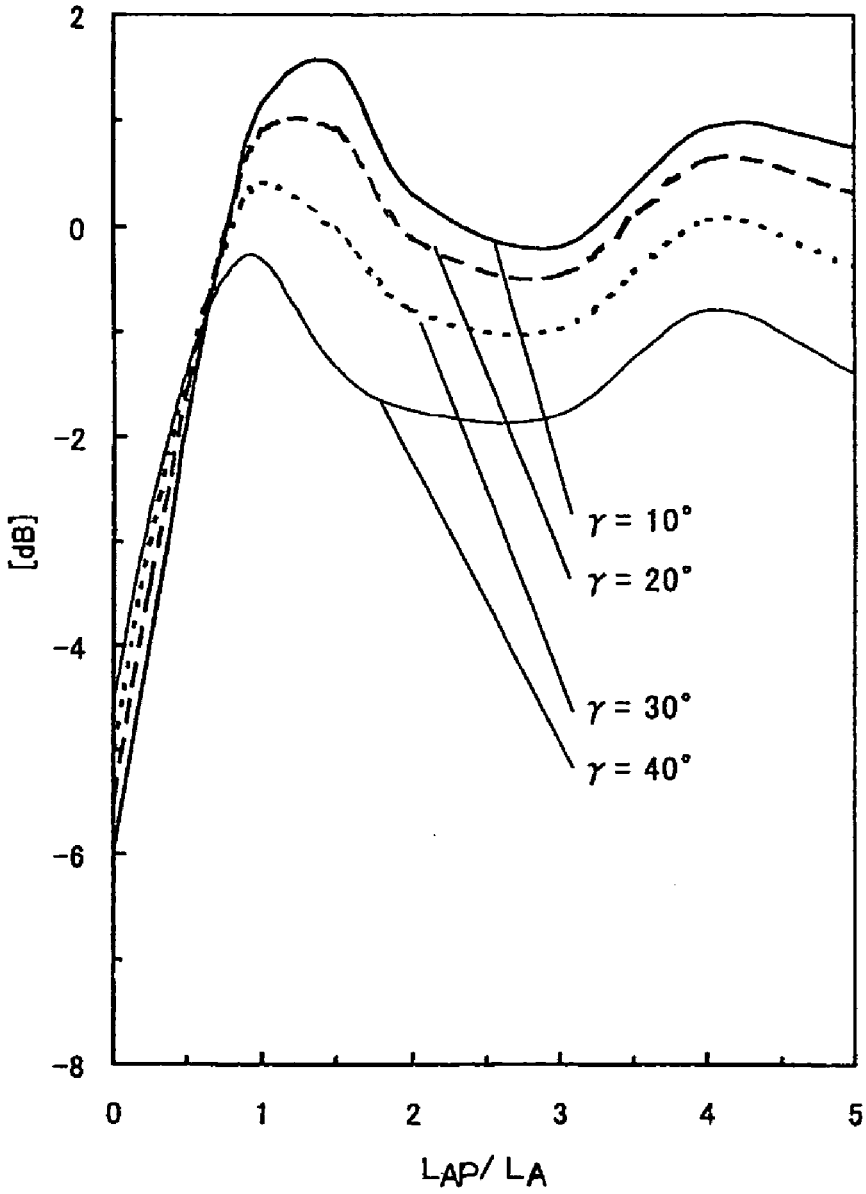
FIG. 16 is a graph showing curves of antenna gain-γ characteristics wherein α is set at 90 deg with γ (positive) being modified in Example 5.
Figure 17:
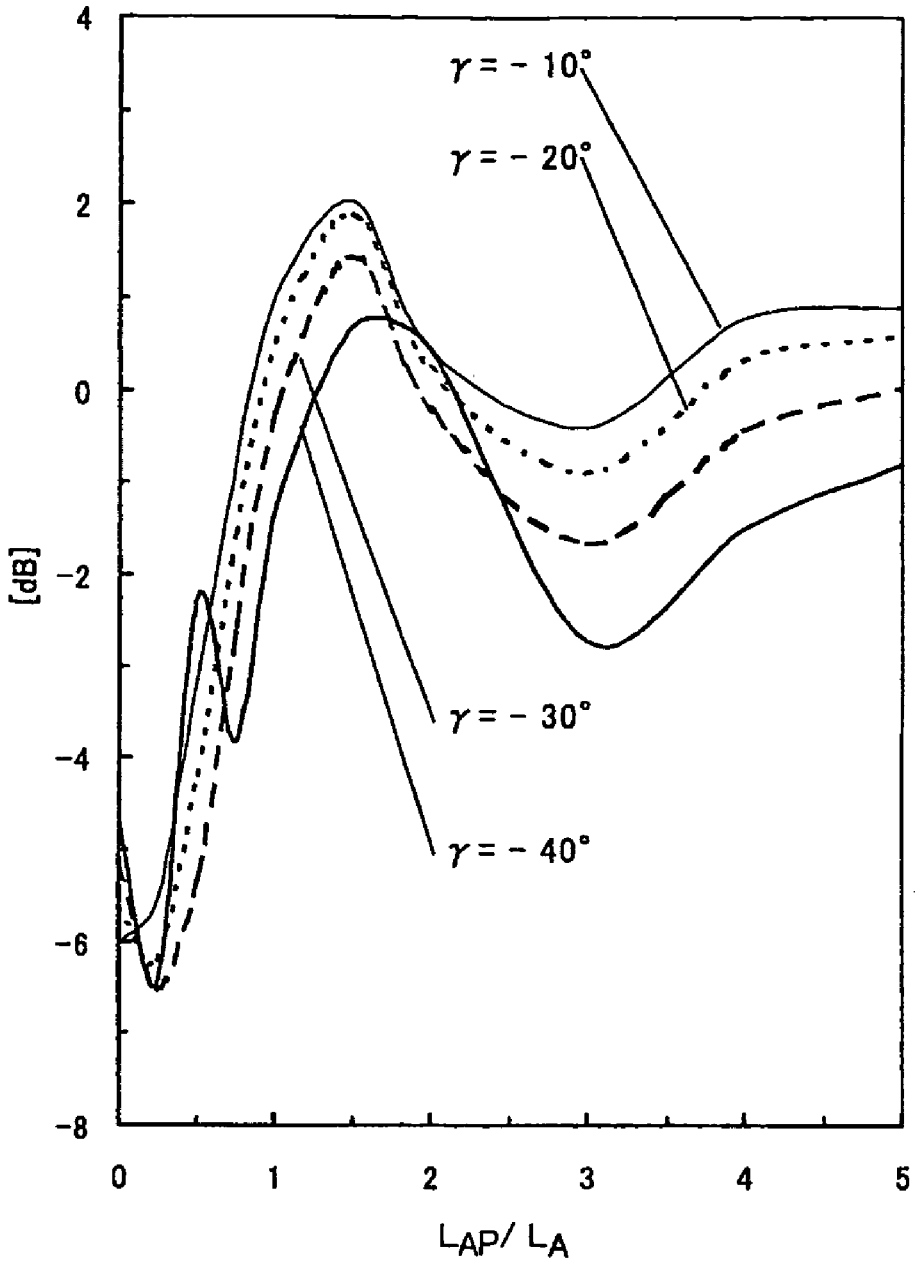
FIG. 17 is a graph showing curves of antenna gain-γ characteristics, wherein α is set at 90 deg with γ (negative) being modified in Example 5.

FIGS. 16 and 17 show antenna gain-$\gamma$ characteristics, which are obtained when $\alpha$ is set at 90 deg and when $\gamma$ is modified.

Figure 18:
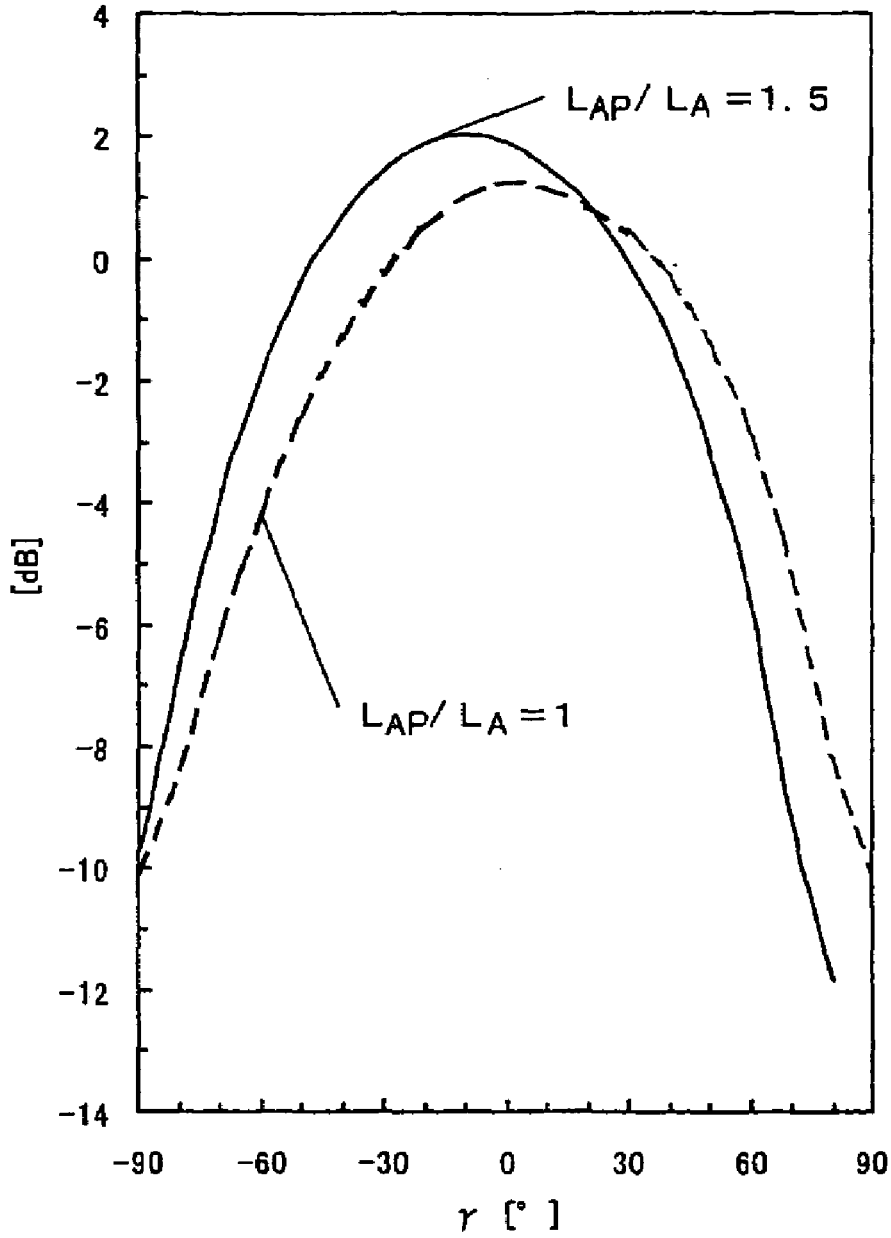
FIG. 18 is a graph showing curves of antenna gain-γ characteristics, wherein ($L_{AP}/L_A$) is 1.0 and 1.5, respectively, in Example 5.

In FIGS. 16 and 17, when $\gamma$ is modified, $\alpha$ is kept at 90 deg, and d is kept at 10 mm. Under these conditions, the imaginary straight line $P_1$ passes through the lateral portion 1*c* of the conductive portion 1 in some cases and does not pass through the lateral portion in the other cases, depending on the values of $\gamma$. FIG. 18 shows antenna gain-$\gamma$ characteristics, which are obtained when ($L_{AP}/L_A$) has two different values of 1.0 and 1.5.

| | |
|---|---|
| W | 330 mm ($3.3\lambda_0$) |
| H | 260 mm ($2.6\lambda_0$) |
| T | 50 mm ($0.5\lambda_0$) |

INDUSTRIAL APPLICABILITY

The present invention is applicable to communication in a TV set, a personal computer and the like.

The entire disclosure of Japanese Patent Application No. 2005-176714 filed on Jun. 16, 2005 including specification, claims, drawings and summary is incorporated herein by reference in its entirety.

What is claimed is:

1. An electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface;

wherein in a case where a plane containing a main part of radiating conductors of the dipole antenna is called an antenna surface, when it is assumed that there is an imaginary straight line $m_1$, which extends in a direction perpendicular to a longitudinal direction of the dipole antenna, passes through a center of the dipole antenna in the longitudinal direction and is parallel to the antenna surface, the dipole antenna is disposed on the lateral portion or in the vicinity of the lateral portion of the display unit so that the imaginary straight line $m_1$ is parallel or substantially parallel to the display screen of the display unit, is parallel or substantially parallel to an upper side or a lower side of the main surface of the conductive portion and passes through the lateral portion of the conductive portion or has contact with the lateral portion;

the electronic device having a function of communicating with the external device through the dipole antenna;

wherein when the dipole antenna has a length $L_A$ in the longitudinal direction thereof, when the conductive portion has a thickness T, and when a radio wave for communication with the external device has a wavelength $\lambda_0$ in the air, the formula of $\lambda_0 \geqq L_A \geqq T$ is established; and at least one of the four sides forming the rectangular or substantially rectangular shape of the conductive portion having a greater length than the wavelength $\lambda_0$;

wherein when the formula of $L_A=(\lambda_0/2)$ or $L_A \cong (\lambda_0/2)$ is established, a shortest distance d between each of the peripheral portions of the radiating conductors and the lateral portion of the conductive portion ranges from $(\lambda_0/20)$ to $3\lambda_0$; and wherein when the formula of $L_A \neq (\lambda_0/2)$ is established or when the formula of $L_A \cong (\lambda_0/2)$ is not established, the shortest distance range from $(L_A/10)$ to $6L_A$.

2. The antenna device according to claim 1, wherein the formula of $1.3\cdot(\lambda_0/2) \geqq L_A \geqq 1.2T$ is established.

3. The antenna device according to claim 1, wherein a smaller angle of the angles, at which the longitudinal direction of the dipole antenna intersects with the display screen, ranges from 5 to 90 deg.

4. The electronic device according to claim 1, wherein the dipole antenna is disposed so that a smaller angle of angles, at which the imaginary line $m_1$ intersects with the display screen of the display unit, ranges from −20 deg to 20 deg.

5. The electronic device according to claim 1, wherein the dipole antenna is disposed so that a smaller angle of angles, at which the imaginary line $m_1$ intersects with the upper side or the lower side of the main surface of the display unit, ranges from −20 deg to 20 deg.

6. An electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface;

wherein when it is assumed that there is an imaginary straight line $P_1$, which passes through a center of the dipole antenna, is parallel to the display screen of the display unit and is parallel to an upper side or a lower side of the main surface of the conductive portion, the dipole antenna is disposed on the lateral portion or in the vicinity of the lateral portion of the display unit so that the imaginary straight line $P_1$ passes the lateral portion of the conductive portion or has contact with the lateral portion;

the electronic device having a function of communicating with the external device through the dipole antenna;

wherein when the dipole antenna has a length $L_A$ in the longitudinal direction thereof, when the conductive portion has a thickness T, and when a radio wave for communication with the external device has a wavelength $\lambda_0$ in the air, the formula of $\lambda_0 \geqq L_A \geqq T$ is established; and at least one of the four sides forming the rectangular or substantially rectangular shape of the conductive portion having a greater length than the length $L_A$;

wherein it is assumed that there is a vertical imaginary surface $S_1$, which is perpendicular to the display screen of the display unit, when a smaller angle of the angles, at which the longitudinal direction of the dipole antenna intersects with the surface $S_1$, is defined as $\gamma$, the formula of $-70$ deg$\leqq 70$ deg is established; and wherein in a case where there is an imaginary straight line n, which has contact with a farthest leading edge of the dipole antenna projecting from a thickness of the conductive portion in a direction perpendicular to the display screen of the display unit, is parallel to the display screen of the display unit and is parallel to the upper side or the lower side of the main surface of the conductive portion, when a shortest distance between the lateral portion of the conductive portion and the imaginary straight line n is defined as $L_{AP}$, the formula of $0.4 \leqq (L_{AP}/L_A) \leqq 2.5$ is established.

7. An electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface;

wherein in a case where a plane containing a main part of radiating conductors of the dipole antenna is called an antenna surface, when it is assumed that there is an imaginary straight line $m_1$, which extends in a direction perpendicular to a longitudinal direction of the dipole antenna, passes through a center of the dipole antenna in the longitudinal direction and is parallel to the antenna surface, the dipole antenna is disposed on the lateral portion or in the vicinity of the lateral portion of the display unit so that the imaginary straight line $m_1$ is parallel or substantially parallel to the display screen of the display unit and is parallel or substantially parallel to an upper side or a lower side of the main surface of the conductive portion;

wherein a smaller angle of angles, at which the longitudinal direction of the dipole antenna intersects with the display screen of the display unit, is defined as $\alpha$, and the dipole antenna has a length $L_A$ in the longitudinal direction thereof;

wherein in a case where there is an imaginary straight line n, which has contact with a farthest leading edge of the dipole antenna projecting from a thickness of the conductive portion in a direction perpendicular to the display screen of the display unit, is parallel to the display screen of the display unit and is parallel to the upper side or the lower side of the main surface of the conductive portion, when a shortest distance between the lateral portion of the conductive portion and the imaginary straight line n is defined as $L_{AP}$, and when the thickness of the conductive portion is defined as T;

at least one of the four sides forming the rectangular or substantially rectangular shape of the conductive portion having a greater length than the length $L_A$; and the following formula (1) is satisfied provided that the formula of $L_A \cdot \sin|\alpha| \leqq T$ is established:

$$0.2 < (L_{AP}/L_A) \leqq 2.5 \quad (1)$$

where $\sin\alpha$ has a value satisfying the formula (1).

8. The electronic device according to claim 7, wherein when the value of $(L_{AP}/L_A)$ is less than 0.6, the angle $|\alpha|$ is from 5 to 90 deg;

when the value of $(L_{AP}/L_A)$ is from 0.6 to 0.9, the angle $|\alpha|$ is from 30 to 90 deg; and when the value of $(L_{AP}/L_A)$ is beyond 0.9, the angle $|\alpha|$ is from 0 to 90 deg.

9. The electronic device according to claim 7, wherein provided that the formula $L_A \cdot \sin|\alpha| \leqq T$ is established, the formula $2 \cdot L_A \geqq T$ is established.

10. An electronic device including a flat display unit having a thickness and a dipole antenna for communication with an external device; comprising:

the display unit including a conductive portion formed in a rectangular or substantially rectangular shape, the conductive portion having a main surface parallel to a display screen of the display unit and a lateral portion positioned at a lateral edge of the main surface, the display unit having the dipole antenna disposed in the lateral portion or in the lateral portion thereof;

the electronic device having a function of communicating with the external device through the dipole antenna;

wherein it is assumed that there is a vertical imaginary surface $S_1$, which is perpendicular to the display screen of the display unit, when a smaller angle of the angles, at which the longitudinal direction of the dipole antenna intersects with the surface $S_1$, is defined as $\gamma$, the formula of $-70$ deg$\leqq 70$ deg is established;

wherein a smaller angle of angles, at which the longitudinal direction of the dipole antenna intersects with the display screen of the display unit, is defined as $\alpha$, and the dipole antenna has a length $L_A$ in the longitudinal direction thereof;

wherein in a case where there is an imaginary straight line n, which has contact with a farthest leading edge of the dipole antenna projecting from a thickness of the conductive portion in a direction perpendicular to the display screen of the display unit, is parallel to the display screen of the display unit and is parallel to the upper side or the lower side of the main surface of the conductive portion, when a shortest distance between the lateral portion of the conductive portion and the imaginary straight line n is defined as $L_{AP}$, and when the thickness of the conductive portion is defined as T;

at least one of the four sides forming the rectangular or substantially rectangular shape of the conductive portion having a greater length than the length $L_A$; and provided that the angle $|\alpha|$ is from 20 to 90 deg, the formula of $0.7 \leqq L_{AP}/L_A \leqq 2.2$.

11. The electronic device according to claim 10, wherein when it is assumed that there is an imaginary straight line $P_1$, which passes through a center of the dipole antenna, is parallel to the display screen of the display unit and is parallel to the upper side or the lower side of the main surface of the conductive portion, the dipole antenna is disposed in such a position that the imaginary straight line $P_1$ does not pass through the lateral portion of the conductive portion.

12. The electronic device according to claim 10, wherein when the value of $(L_{AP}/L_A)$ is less than 0.6, the angle $|\alpha|$ is from 5 to 90 deg;

when the value of $(L_{AP}/L_A)$ is from 0.6 to 0.9, the angle $|\alpha|$ is from 30 to 90 deg; and when the value of $(L_{AP}/L_A)$ is beyond 0.9, the angle $|\alpha|$ is from 0 to 90 deg.

13. The electronic device according to claim 10, wherein the dipole antenna is disposed in such a position that the dipole antenna has a top end located at a level of not higher than a top end of the conductive portion, and that the dipole antenna has a bottom end located at a level of not lower than a bottom end of the conductive portion.

14. The electronic device according to claim 10, wherein the dipole antenna has radiating conductors, and a shortest distance between a peripheral portion of each of the radiating conductors and the lateral portion of the conductive portion is from $(L_A/10)$ to $6L_A$.

15. The electronic device according to claim 10, wherein the conductive portion is formed in a rectangular parallelepiped shape, a plate shape, a casing shape, a shape regarded as being equivalent in an electrical sense to a vessel shape comprising a frame with a bottom plate disposed thereon.

16. The electronic device according to claim 10, wherein the dipole antenna has radiating conductors partly or entirely disposed in planar fashion on or in a dielectric substrate or a dielectric member.

17. The electronic device according to claim 10, wherein the display unit comprises a liquid crystal display unit or a plasma display unit.

18. The electronic device according to claim 10, wherein the electronic device comprises a TV set or a personal computer.

19. The electronic device according to claim 10, wherein the conductive portion comprises one selected from a metal casing, a driving circuit for display and a peripheral circuit for display.

20. The electronic device according to claim 10, wherein a radio wave, which is used for communication with the external device, has at least one of frequencies of from 1 to 300 GHz.

21. The electronic device according to claim 10, wherein a radio wave, which is used for communication with the external device, contains at least one of frequencies of from 1 to 11 GHz.

* * * * *

UNITED STATES PATENT AND TRADEMARK OFFICE

CERTIFICATE OF CORRECTION

PATENT NO. : 7,446,716 B2
APPLICATION NO. : 11/451475
DATED : November 4, 2008
INVENTOR(S) : Watanabe et al.

It is certified that error appears in the above-identified patent and that said Letters Patent is hereby corrected as shown below:

On the title page, Item (75), the Inventors information is incorrect. Item (75) should read:

Item -- (75) Inventors: Fuminori Watanabe, Yokohama (JP); Ryuta Sonoda, Yokohama (JP); Koji Aoki, Yokohama (JP); Koji Ikawa, Yokohama (JP) --

Signed and Sealed this

Third Day of February, 2009

John Doll

JOHN DOLL
*Acting Director of the United States Patent and Trademark Office*